US007607319B2

(12) United States Patent
Okamoto

(10) Patent No.: US 7,607,319 B2
(45) Date of Patent: Oct. 27, 2009

(54) POSITIVE DISPLACEMENT EXPANDER AND FLUID MACHINERY

(75) Inventor: Masakazu Okamoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 310 days.

(21) Appl. No.: 11/659,193

(22) PCT Filed: Aug. 5, 2005

(86) PCT No.: PCT/JP2005/014399

§ 371 (c)(1),
(2), (4) Date: Feb. 2, 2007

(87) PCT Pub. No.: WO2006/013959

PCT Pub. Date: Feb. 9, 2006

(65) Prior Publication Data

US 2008/0307797 A1 Dec. 18, 2008

(30) Foreign Application Priority Data

Aug. 5, 2004 (JP) ..... 2004-229809

(51) Int. Cl.
*F25B 41/06* (2006.01)

(52) U.S. Cl. ..... 62/527

(58) Field of Classification Search ..... 62/527, 62/224, 225, 126, 528
See application file for complete search history.

(56) References Cited

U.S. PATENT DOCUMENTS

| | | | | |
|---|---|---|---|---|
| 4,843,821 | A | 7/1989 | Paul et al. | |
| 4,964,275 | A | 10/1990 | Paul et al. | |
| 7,165,421 | B2 * | 1/2007 | Tsugawa | 62/527 |

FOREIGN PATENT DOCUMENTS

| | | | |
|---|---|---|---|
| JP | 58-48706 | A | 3/1983 |
| JP | 59-024993 | U | 2/1984 |
| JP | 61-122301 | U | 8/1986 |
| JP | 61-122302 | U | 8/1986 |
| JP | 7-317686 | A | 12/1995 |
| JP | 8-338356 | A | 12/1996 |
| JP | 2000-227080 | A | 8/2000 |
| JP | 2001-116371 | A | 4/2001 |
| JP | 2003-269103 | A | 9/2003 |
| JP | 2004-190559 | A | 7/2004 |
| JP | 2004-197640 | A | 7/2004 |
| WO | WO-2003/089766 | A1 | 10/2003 |

* cited by examiner

*Primary Examiner*—Melvin Jones
(74) *Attorney, Agent, or Firm*—Birch, Stewart, Kolasch & Birch, LLP

(57) ABSTRACT

When an expansion mechanism (60) having an expansion chamber (62) is equipped with a backflow prevention mechanism (80) to suppress the outflow of fluid from the expansion chamber (62) to a communication path (72), it is possible to reduce dead volume in the expansion chamber (62) during operation with the circulation control mechanism (73,75,76) closed.

9 Claims, 26 Drawing Sheets

(A)

(B)

(A)

(B)

(A)

(B)

(A)

(B)

(A)

(B)

(A)

(B)

(A)

(B)

(A)

(B)

(A)

(B)

POSITIVE DISPLACEMENT EXPANDER AND FLUID MACHINERY

TECHNICAL FIELD

The present invention relates to a positive displacement expander equipped with an expansion mechanism, which generates power when a high-pressure fluid expands, and to a fluid machinery equipped with the expander.

BACKGROUND ART

A positive displacement expander such as a rotary expander is conventionally known as an expander which serves to generate power when a high-pressure fluid expands (for example, refer to patent document 1). Such expander is used for an expansion process of a vapor compression type refrigeration cycle (for example, refer to patent document 2).

The above-mentioned expander comprises a cylinder and a piston revolving along the inner circumference of the cylinder, and an expansion chamber formed between the cylinder and the piston is partitioned into the suction/expansion side and the discharge side. As the piston revolves, the suction/expansion side in the expansion chamber is changed into the discharge side, and the discharge side is changed into the suction/expansion side alternately, thus the suction/expansion action and the discharge action of the high-pressure fluid are concurrently and collaterally carried out. In this manner, the expander recovers the rotation power generated due to expansion of the fluid in order to utilize the rotation power as, for example, a drive source of a compressor.

An expansion ratio, the density ratio of the suction fluid to the discharge fluid is predetermined as a design expansion ratio for the above-mentioned expander. The design expansion ratio is determined on the basis of the pressure ratio of the high-pressure to the low-pressure in a vapor compression type refrigeration cycle that is carried out using the expander.

In the actual operation, however, since the temperature subject to cooling or the temperature subject to radiation (heating) vary, the above-mentioned pressure ratio of the refrigeration cycle may become smaller than that assumed in the design phase. Specifically, when the low-pressure in the vapor compression type refrigeration cycle rises, the pressure of the fluid expanded may be lowered than the above-mentioned low-pressure in the design expansion ratio (herein after referred to as expansion pressure). In this case, since the expander excessively expands the fluid, the pressure of the fluid dropped to the above-mentioned expansion pressure is raised once up to the above-mentioned low-pressure before discharging the fluid. Accordingly, a workload which results when the fluid is excessively expanded by the expander, and extra power for discharging the fluid having increased pressure may be consumed. Thus, an expander capable of reducing overexpansion loss yielded due to such reasons has been conventionally desired. To solve such problems, the applicant of the present application devised an expander which by passes part of the fluid on the inflow side (high-pressure fluid) of the expansion chamber to the suction/expansion process position. Specifically, the expander is equipped with a communication path for diverging from the inflow side of the fluid into the expansion chamber and communicating with the suction/expansion process position of the expansion chamber. The communication path is provided with an electric-operated valve as a circulation control mechanism for regulating a flow rate of the high-pressure fluid that is bypassed through the communication path.

In the expander of the above-mentioned configuration, for example, when the low-pressure in the refrigeration cycle is higher than the expansion pressure of the expander as mentioned above, the electric-operated valve is opened at a predetermined degree of opening, and the high-pressure fluid is bypassed through the communication path to the suction/expansion process position of the expansion chamber. Then by raising the expansion pressure of the expander close to the above-mentioned low-pressure, the above-mentioned overexpansion loss can be reduced (refer to patent document 3).

Patent document 1: Japanese Patent Application Publication No. 8-338356

Patent document 2: Japanese Patent Application Publication No. 2001-116371

Patent document 3: Japanese Patent Application Publication No. 2004-197640

DISCLOSURE OF THE INVENTION

Problems to be Solved by the Invention

When, in the expander adapted to reduce overexpansion loss in the above manner, the low-pressure of the refrigeration cycle is approximately equal to the expansion pressure of the expander, a normal expansion operation is carried out under the condition where the electric-operated valve is totally closed. In the case of the condition where the electric-operated valve is totally closed, the space of the communication path between the electric-operated valve and the expansion chamber turns out to be a dead volume that communicates with the expansion chamber. As a result, there is a problem that the power recovery efficiency of the expander is lowered.

This will be described in detail by referring to FIGS. 13 and 14. FIG. 13 is a graph showing a relationship between changes in volume and pressure of the expansion chamber under the ideal condition, in which there is no dead volume as described above. This graph shows a case where $CO_2$ with higher pressure than critical pressure is used for expanded fluid as a refrigerant.

First of all, when the volume of the expansion chamber increases from the point a to the point b in FIG. 13, the high-pressure fluid is supplied into the expansion chamber. Next, the point b is exceeded, the high-pressure fluid is started to be expanded simultaneously when the high-pressure fluid is stopped from supplying. The pressure of the high-pressure fluid in the expansion chamber greatly drops to the point c and becomes saturated. Then, this fluid is partly evaporated and turns into a state of gas-liquid two phase, and its pressure gradually drops to the point d. After the cylinder volume of the expansion chamber becomes maximum at the point d and the expansion chamber turns to the discharge side, the cylinder volume of the expansion chamber is reduced to the point e and the low-pressure fluid is discharged from the expansion chamber. Then back to the point a, the high-pressure fluid is supplied to the expansion chamber again.

On the contrary, as shown in FIG. 14, in the case where the space of the communication path between the electric-operated valve and the expansion chamber is dead volume, when expansion of the high-pressure fluid is started from the point b, the high-pressure fluid expands excessively by an amount of the above-mentioned dead volume. Therefore, the pressure of the fluid at the point b to the point d drops from the point b through point c' to point d so that the volume expands with behavior lower than that of the pressure drop from the point b through point c to point d, which is seen under the above-mentioned ideal condition. Accordingly, the amount of power recovered by the expansion of the fluid in the expander, that is, the area of S1 decreases by the area of S2 as compared with the expander under the ideal condition. Consequently, the power recovery efficiency of the expander is lowered.

The present invention has been accomplished in view of such problems, and it is an object of the present invention to suppress a reduction in power recovery efficiency attributable to dead volume in the expansion chamber formed in the communication path, in the capacitive compressor equipped with the communication path and the circulation control mechanism.

Means to Solve the Problems

The present invention relates to providing, in the expansion mechanism having the expansion chamber, a backflow prevention mechanism to suppress the outflow of the fluid from the expansion chamber to the communication path side.

Specifically, a first invention is predicated on a positive displacement expander comprising an expansion mechanism (60) in which high-pressure fluid is expanded in an expansion chamber (62) to generate power, a communication path (72) which diverges from the fluid inflow side of the expansion chamber (62) and communicates with the suction/expansion process position of the expansion chamber (62), and a circulation control mechanism (73,75,76) disposed in the communication path (72) for regulating a flow rate of the fluid. The positive displacement expander is characterized in that the expansion mechanism is provided with a backflow prevention mechanism (80) for preventing the fluid from flowing from the expansion chamber (62) to the communication path (72). The "backflow prevention mechanism" serves to prevent the fluid from flowing from the expansion chamber (62) to the communication path (72), and also allows the fluid to flow in the opposite direction, that is, from the communication path (72) into the expansion chamber (62).

According to the above-mentioned first invention, for example, when the (expansion) pressure of the fluid expanded in the expansion mechanism (60) is smaller than the low-pressure of the refrigeration cycle immediately before being discharged from the expansion chamber (72), it is possible to bring the circulation control mechanism (73,75,76) into a state of opening. When the circulation control mechanism (73,75,76) is brought into a state of opening in this manner, the high-pressure fluid which diverges from the fluid inflow side and flows through the communication path (72) is introduced to the suction/expansion process position. As a result, the expansion pressure in the expansion chamber (62) rises. Accordingly, the difference between the expansion pressure in the expansion chamber (62) and the low-pressure in the refrigeration cycle becomes smaller, thereby reducing the above-mentioned overexpansion loss.

On the one hand, for example, when the expansion pressure in the expansion chamber (62) is approximately equal to the low-pressure in the refrigeration cycle, it is possible to bring the circulation control mechanism (73,75,76) into a state of closing. In this case, the high-pressure fluid on the fluid inflow side is not diverged to the communication path (72), but introduced directly to the suction side of the expansion chamber (62). The expansion mechanism (60) then expands the fluid through the normal operation.

According to the present invention, the expansion mechanism (60) is equipped with the backflow prevention mechanism (80) to prevent the fluid from flowing from the expansion chamber (62) to the communication path (72). Accordingly, even if the circulation control mechanism (73, 75,76) is in a state of total closing, it is possible to prevent the fluid in the expansion chamber (62) from flowing into the space from the circulation control mechanism (73,75,76) in the communication path (72) to the expansion chamber (62). Therefore, it is possible to keep a part of the space in the communication path (72) from becoming dead volume of the expansion chamber (62).

A second invention is characterized in that the backflow prevention mechanism (80) also serves as the circulation control mechanism in the positive displacement expander according to the first invention.

According to the second invention, the backflow prevention mechanism (80) is provided with the circulation control mechanism. That is, when the backflow prevention mechanism (80) is in a state of opening, it is possible to introduce the high-pressure fluid from the communication path (72) to the expansion chamber (62). On the one hand, when the backflow prevention mechanism (80) is in a state of total closing, it is possible to stop introducing the high-pressure fluid from the communication path (72) into the expansion chamber (62), and at same time, to prevent the fluid from flowing from the expansion chamber (62) into the communication path (72).

A third invention is characterized in that in the positive displacement expander according to the first invention, the backflow prevention mechanism (80) is disposed closer to the expansion chamber (72) than the above-mentioned circulation control mechanism (73,75,76) within the communication path (72). At this point, the closer the backflow prevention mechanism (80) is to the expansion chamber (62) within the communication path (72), the more it is favorable.

In the above-mentioned third invention, the backflow prevention mechanism (80) and the circulation control mechanism (73,75,76) are provided separately, unlike the second invention. At this point, since the backflow prevention mechanism (80) is disposed closer to the expansion chamber (62) than the circulation control mechanism (73,75,76) within the communication path (72), dead volume formed in the communication path (72) corresponds to the space from the backflow prevention mechanism (80) to the expansion chamber (62) for the expander according to the present invention, as opposed to conventional expanders, where the dead volume corresponds to the space from the circulation control mechanism (73,75,76) to the expansion chamber (72). Therefore, it is possible to minimize the dead volume formed in the communication path (62) than conventional expander.

A fourth invention is characterized in that the backflow prevention mechanism (80) is comprised of a non-return valve in the positive displacement expander according to the third invention.

According to the above-mentioned forth invention, a non-return valve constitutes the backflow prevention mechanism (80). This non-return valve prevents the fluid from flowing from the expansion chamber (72) into the communication path (62).

A fifth invention is characterized in that the circulation control mechanism (73,75,76) is comprised of an electric-operated valve (73) capable of adjusting the degree of opening in the positive displacement expander according to one of the first to fourth inventions.

In the above-mentioned fifth invention, the high-pressure fluid flow which is bypassed through the communication path (72) to the expansion chamber (62) by adjusting the degree of opening of the electric-operated valve (73), is regulated to a given flow rate. At this point, when the electric-operated valve (73) is in a state of total closing, the backflow prevention mechanism (80) prevents the fluid from flowing from the expansion chamber (62) into the communication path (62).

Therefore, it is possible to avoid the space in the communication path (72) from the above-mentioned electric-operated valve (73) to the expansion chamber (62) from becoming dead volume.

A sixth invention is characterized in that the circulation control mechanism (73,75,76) is comprised of an electromagnetically opening/closing valve (75) capable of opening and closing in the positive displacement expander according to one of the first to fourth inventions.

In the above-mentioned sixth invention, by controlling the opening/closing timing of the electromagnetically opening/closing valve (75), the high-pressure fluid flow which is bypassed through the communication path (72) to the expansion chamber (62) is regulated to a predetermined flow rate. At this point, when the electromagnetically opening/closing valve (75) is in a state of total closing, the backflow prevention mechanism (80) prevents the fluid from flowing from the expansion chamber (62) into the communication path (62). Therefore, it is possible to avoid the space of the communication path (72) from the above-mentioned electromagnetically opening/closing valve (75) to the expansion chamber (62) from becoming dead volume.

A seventh invention is characterized in that the circulation control mechanism (73,75,76) is comprised of a differential pressure regulating valve (76) which opens when the differential pressure between the pressure of the fluid during the expansion process in the expansion chamber (62) and the pressure on the fluid outflow side is greater than a predetermined value, in the positive displacement expander according to one of the first to fourth inventions.

In the above-mentioned seventh invention, the differential pressure between the pressure of the fluid during the expansion process of the expansion chamber (62) and the pressure on the fluid outflow side is detected, and the differential pressure valve (76) opens when the differential pressure becomes greater than a predetermined value. As a result, the high-pressure fluid is introduced through the communication path (72) into the expansion chamber (62). Therefore, it is possible to approximate the pressure of the fluid during the above-mentioned expansion process to the pressure on the fluid outflow side. Accordingly, it is possible to reduce over-expansion loss in this expansion mechanism (60).

On the other hand, when the differential pressure between the pressure of the fluid during the expansion process of the expansion chamber (62) and the pressure on the fluid outflow side is less than a predetermined value, the differential pressure valve (76) is shut off. As a result, supply of the high-pressure fluid through the communication path (72) to the expansion chamber (62) is stopped. At this point, when the differential pressure regulating valve (76) is in a state of total closing, the backflow prevention mechanism (80) prevents the fluid from flowing from the expansion chamber (62) into the communication path (62). Therefore, it is possible to avoid the space of the communication path (72) from the above-mentioned differential pressure regulating valve (76) to the expansion chamber (62) from becoming dead volume.

An eighth invention is characterized in that the expansion mechanism (60) carries out the expansion process of a vapor compression type refrigeration cycle, in the positive displacement expander according to any one of the first to seventh inventions.

In the above-mentioned eighth invention, the backflow prevention mechanism (80) prevents the fluid from flowing from the expansion chamber (62) into the communication path (72), in the positive displacement expander which carries out the expansion process of the vapor compression type refrigeration cycle.

A ninth invention is characterized in that the expansion mechanism (60) is configured to carry out the expansion process of a vapor compression type refrigeration cycle in which the high pressure becomes super-critical pressure in the positive displacement expander according to any one of the first to seventh inventions.

In the above-mentioned ninth invention, the backflow prevention mechanism (80) prevents the fluid from flowing from the expansion chamber (62) into the communication path (72) in the positive displacement expander for carrying out the expansion process of what is called a super-critical cycle in which the high-pressure becomes critical pressure.

The tenth invention is characterized in that the expansion mechanism (60) is configured to carry out the expansion process of a vapor compression type refrigeration cycle using a carbon dioxide refrigerant, in the positive displacement expander according to the ninth invention.

In the above-mentioned tenth invention, the backflow prevention mechanism (80) prevents the fluid from flowing from the expansion chamber (62) into the communication path (72) in the positive displacement expander for carrying out the expansion process of a super-critical cycle using a $CO_2$ refrigerant.

An eleventh invention is characterized in that the expansion mechanism (60) is configured to be a rotary expansion mechanism in which rotation power is recovered by means of expansion of the fluid, in the positive displacement expander according to any one of the first to tenth inventions. The "rotary expansion mechanism" stands for an expansion mechanism configured by swing, rotary, scroll type fluid machineries, and so forth.

In the above-mentioned eleventh invention, the backflow prevention mechanism (80) prevents the fluid from flowing from the expansion chamber (62) into the communication path (72) in the positive displacement expander having the rotary expansion mechanism.

A twelfth invention is predicted on a fluid machinery equipped with, in a casing (31), a positive displacement expander (60), a motor (40), and a compressor (50) driven by the above-mentioned positive displacement expander (60) and the motor (40) in order to compress the fluid. This fluid machinery is characterized in that the positive displacement expander (60) is configured by the positive displacement expander according to any one of the first to eleventh inventions.

In the twelfth invention, rotation power from the positive displacement expander (60) according to the first to eleventh inventions and rotation power from the motor (40) are transmitted to drive the compressor (50).

Effects of the invention

According to the above-mentioned first invention, when the expander normally operates under the condition where the circulation control mechanism (73,75,76) is totally closed, the backflow prevention mechanism (80) prevents the fluid from flowing from the expansion chamber (62) into the communication path (72). Accordingly, it is possible to keep a part of the communication path (72) from becoming dead volume of the expansion chamber (72). This prevents the rotation power obtained by the expander from reducing to the area of S1, which results from dropping of the pressure from the point b through the point c' to the point d during the expansion process, as shown in, for example, FIG. 14. Therefore, the expander can expand the fluid in a manner close to the ideal condition as shown in FIG. 13, and it is possible to improve the power recovery efficiency obtained by the expander.

According to the above-mentioned second invention, the backflow prevention mechanism (80) is equipped with the function of the circulation control mechanism. Accordingly, the backflow prevention mechanism (80) can adjust the amount of bypass flow from the communication path (72) to the suction/expansion process position of the expansion chamber (72) and can also prevent the fluid from flowing from the expansion chamber (72) into the communication path (72). Therefore, the number of parts for the expander can be reduced.

According to the above-mentioned third invention, it is possible to reliably reduce the dead volume of the communication path (72) by disposing the backflow prevention mechanism (80) closer to the expansion chamber (62) than to the circulation control mechanism (73,75,76) in the communication path (72). Besides, by disposing the backflow prevention mechanism (80) closer to the expansion chamber (62) than to the circulation control mechanism (73,75,76), the dead volume of the communication path (72) does not become large no matter where the above-mentioned circulation control mechanism (73,75,76) is disposed in the communication path (72). Therefore, for example, when the communication path (72) is formed inside the expansion mechanism (60) and communicates with the expansion chamber (62), the above-mentioned circulation control mechanism (73,75,76) can also be disposed in the communication path (72) located outside the expansion mechanism (60). This facilitates replacement and maintenance of the circulation control mechanism (73, 75,76), which tends to have a relatively complicated structure.

According to the above-mentioned forth invention, a non-return valve is used as the backflow prevention mechanism (80). Accordingly, it is possible to prevent the fluid from flowing from the expansion chamber (62) into the communication path (72) and also to effectively keep a part of the communication path (72) from becoming dead volume of the expansion chamber (62).

According to the above-mentioned fifth invention, it is possible to easily adjust the amount of bypass flow of the high-pressure fluid through the communication path (72) by configuring the circulation control mechanism (73,75,76) with the electric-operated valve (73). Accordingly, in the case where the expander is used for the expansion process of the refrigeration cycle, when the low-pressure of the refrigeration cycle is lower than the expansion pressure in the expansion chamber (62), it is possible to introduce a predetermined flow rate of the high-pressure fluid from the communication path (72) into the expansion chamber (62) and thereby to approximate the above-mentioned expansion pressure to the low-pressure of the refrigeration cycle. Therefore, it is possible to further improve the power recovery efficiency of the expander.

According to the above-mentioned sixth invention, it is possible to easily adjust the amount of bypass flow of the high-pressure fluid by configuring the circulation control mechanism (73,75,76) with the electromagnetically opening/closing valve (75) and changing the opening/closing timing of the electromagnetically opening/closing valve (75). Accordingly, it is possible to configure the circulation control mechanism by a relatively simple structure, and at the same time, to obtain similar effects to those in the fifth invention.

According to the above-mentioned seventh invention, the high-pressure fluid is introduced from the communication path (72) into the expansion chamber (62) by opening the differential pressure regulating valve (76) when the differential pressure between the pressure of the fluid during the expansion process in the expansion chamber (62) and the pressure on the fluid outflow side becomes lager than a predetermined value. Also, the above-mentioned pressure of the fluid during the expansion process is approximated to the pressure on the fluid outflow side. Accordingly, for example, when the expander is used for the expansion process of the refrigeration cycle, it is possible to make the expansion pressure of the expansion chamber (62) approximately equal to the low-pressure of the refrigeration cycle. Therefore, it is possible to reliably reduce the overexpansion loss of the expander and improve the power recovery efficiency.

According to the above-mentioned eighth invention, the expander according to the present invention is utilized for the expansion process of a vapor compression type refrigeration cycle. Therefore, it is possible to effectively reduce the overexpansion loss of the expander during the above-mentioned compression refrigeration cycle. Besides, it is possible to reliably minimize the dead volume in the communication pipe (80) with the backflow prevention mechanism (80) and to effectively recover the power obtained during the expansion process of the above-mentioned compression refrigeration cycle.

According to the above-mentioned ninth invention, the expander according to the present invention is used for the expansion process of a super-critical cycle. Incidentally, since the pressure of the refrigerant flowing into the expander is relatively high during the expansion process of the super-critical cycle, the amount of power recovery tends to be reduced due to the dead volume of the expansion chamber (72). On the one hand, since such dead volume of the expansion chamber (72) is reduced as much as possible in the present invention, it is possible to effectively improve the power recovery efficiency of the expander.

According to the above-mentioned tenth invention, the expander according to the present invention is utilized for the expansion process of a super-critical cycle using a $CO_2$ refrigerant. Therefore, it is possible to obtain the above-mentioned effects according to the ninth invention.

According to the above-mentioned eleventh invention, the expander according to the present invention is applied to a rotary expander, as represented by swing-, rotary-, and scroll-type. Accordingly, it is possible to improve the recovery efficiency of the rotation power obtained by expansion of the fluid by the rotary expander.

According to the above-mentioned twelfth invention, the positive displacement expander (60) of the present invention is applied to a fluid machinery equipped with a compressor (50) and a motor (40). Accordingly, it is possible to effectively drive the compressor (50) by improving the power recovery efficiency of the positive displacement expander (60) while reducing the power of the above-mentioned compressor (50) served by the motor (40). Besides, by utilizing the compressor (50) of the fluid machinery for the compression process while utilizing the positive displacement expander (60) of the fluid machinery for the expansion process of the vapor compression type refrigeration cycle, it is possible to perform the refrigeration cycle with a superior energy-saving property.

Figure 1:
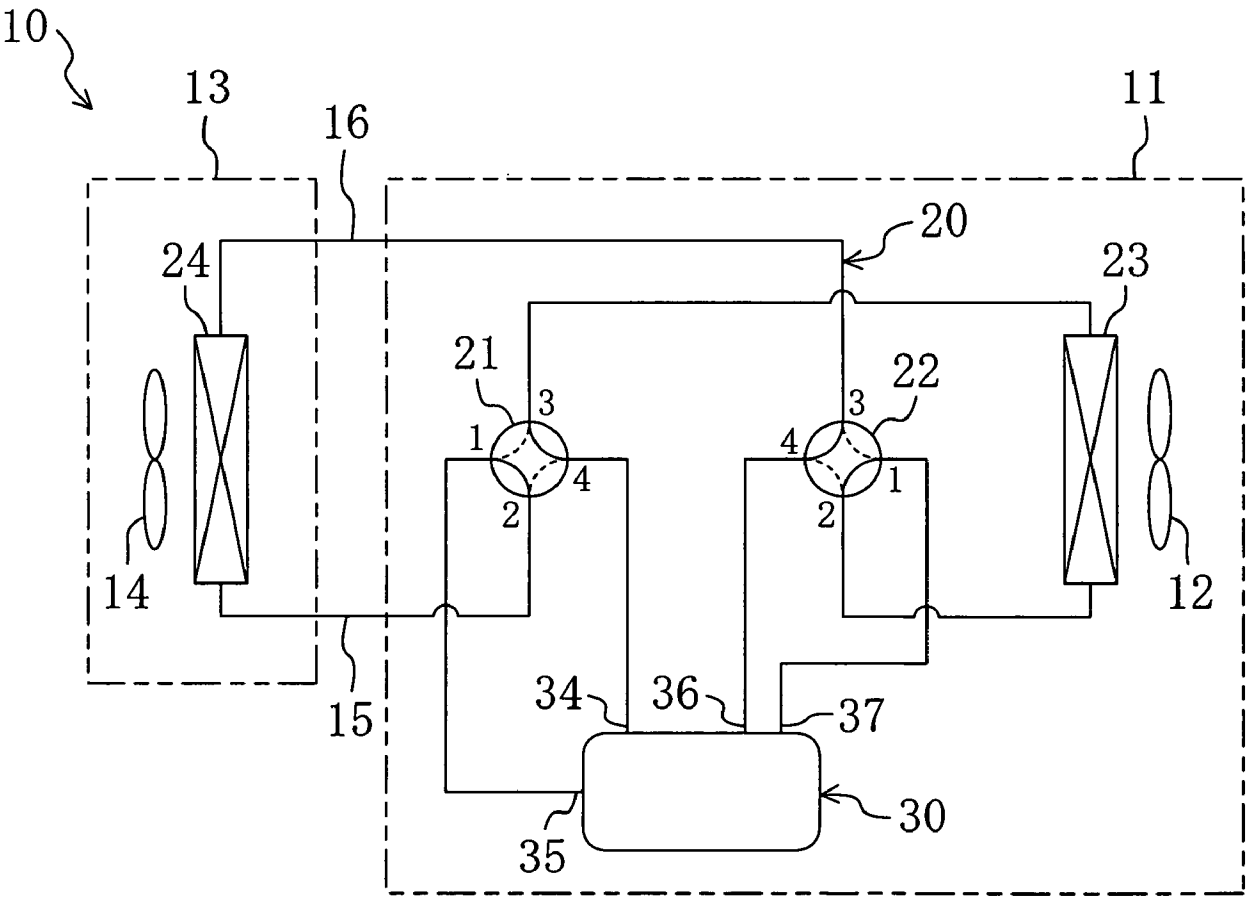
FIG. 1 is a piping systematic diagram of an air conditioner according to embodiment 1.

DESCRIPTION OF THE REFERENCE NUMERALS AND SIGNS (10) Air conditioner
(20) Refrigerant circuit
(30) Compression/expansion unit (fluid machinery)
(31) Casing
(40) Motor
(50) Compressor
(60) Expansion mechanism (positive displacement expander)
(61) Cylinder
(62) Expansion chamber
(72) Communication pipe (communication path)
(73) Electric-operated valve (circulation control mechanism)
(75) Electromagnetically opening/closing valve (circulation control mechanism)
(76) Differential pressure valve (circulation control mechanism)
(80) Non-return valve (backflow prevention mechanism)

BEST MODE FOR CARRYING OUT THE INVENTION

Embodiments of the present invention will be described in detail by referring to the drawings.

Embodiment 1 of the Invention

Embodiment 1 is a configuration of an air conditioner (10) using a fluid machinery of the present invention.

Overall Configuration of Air Conditioner

As shown in FIG. 1, the above-mentioned air conditioner (10) is of what is called separate type and equipped with an outdoor equipment (11) located outdoors and an indoor equipment (13) located indoors. The outdoor equipment (11) includes an outdoor fan (12), an outdoor heat exchanger (23), a first four-way switching valve (21), a second four-way switching valve (22), and a compression expansion unit (30). On the one hand, the indoor equipment (13) includes an indoor fan (14) and an indoor heat exchanger (24). The above-mentioned outdoor equipment (11) is connected with the above-mentioned indoor equipment (13) by a pair of communication pipes (15, 16).

The above-mentioned air conditioner (10) is provided with a refrigerant circuit (20). The refrigerant circuit (20) is a closed circuit to which the compression/expansion unit (30) and the indoor heat exchanger (24) are connected. Besides, the refrigerant circuit (20) is filled with carbon dioxide as a refrigerant.

Both the above-mentioned outdoor heat exchanger (23) and the indoor heat exchanger (24) are comprised of a cross-fin type fin and tube heat exchanger. In the outdoor heat exchanger (23), the refrigerant circulating through the refrigerant circuit (20) exchanges heat with outdoor air. In the indoor heat exchanger (24), the refrigerant circulating through the refrigerant circuit (20) exchanges heat with indoor air.

The above-mentioned first four-way switching valve (21) is equipped with four ports. The first four-way switching valve (21) has a first port connected to a discharge port (35) of the compression/expansion unit (30), a second port connected to one end of the indoor heat exchanger (24) through the communication pipe (15), a third port connected to one end of the outdoor heat exchanger (23), and a fourth port connected to a suction port (34) of the compression/expansion unit (30). The first four-way switching valve (21) is configured be switchable between the state of the first port communicating with the second port and the third port communicating with the fourth port (as shown by a solid line in FIG. 1) and the state of the first port communicating with the third port and the second port communicating with the fourth port (as shown by a broken line in FIG. 1).

The above-mentioned second four-way switching valve (22) is equipped with four ports. The second four-way switching valve (22) has a first port connected to an outflow port (37) of the compression/expansion unit (30), a second port connected to the other end of the outdoor heat exchanger (23), a third port connected to the other end of the indoor heat exchanger (24) through the communication pipe (16), and a fourth port connected to an inflow port (36) of the compression/expansion unit (30). The second four-way switching valve (22) is configured to be switchable between the state of the first port communicating with the second port and the third port communicating with the fourth port (as shown by a solid line in FIG. 1) and the state of the first port communicating with the third port and the second port communicating with the fourth port (as shown by a broken line in FIG. 1).

<<Configuration of Compression/Expansion Unit>>

Figure 2:
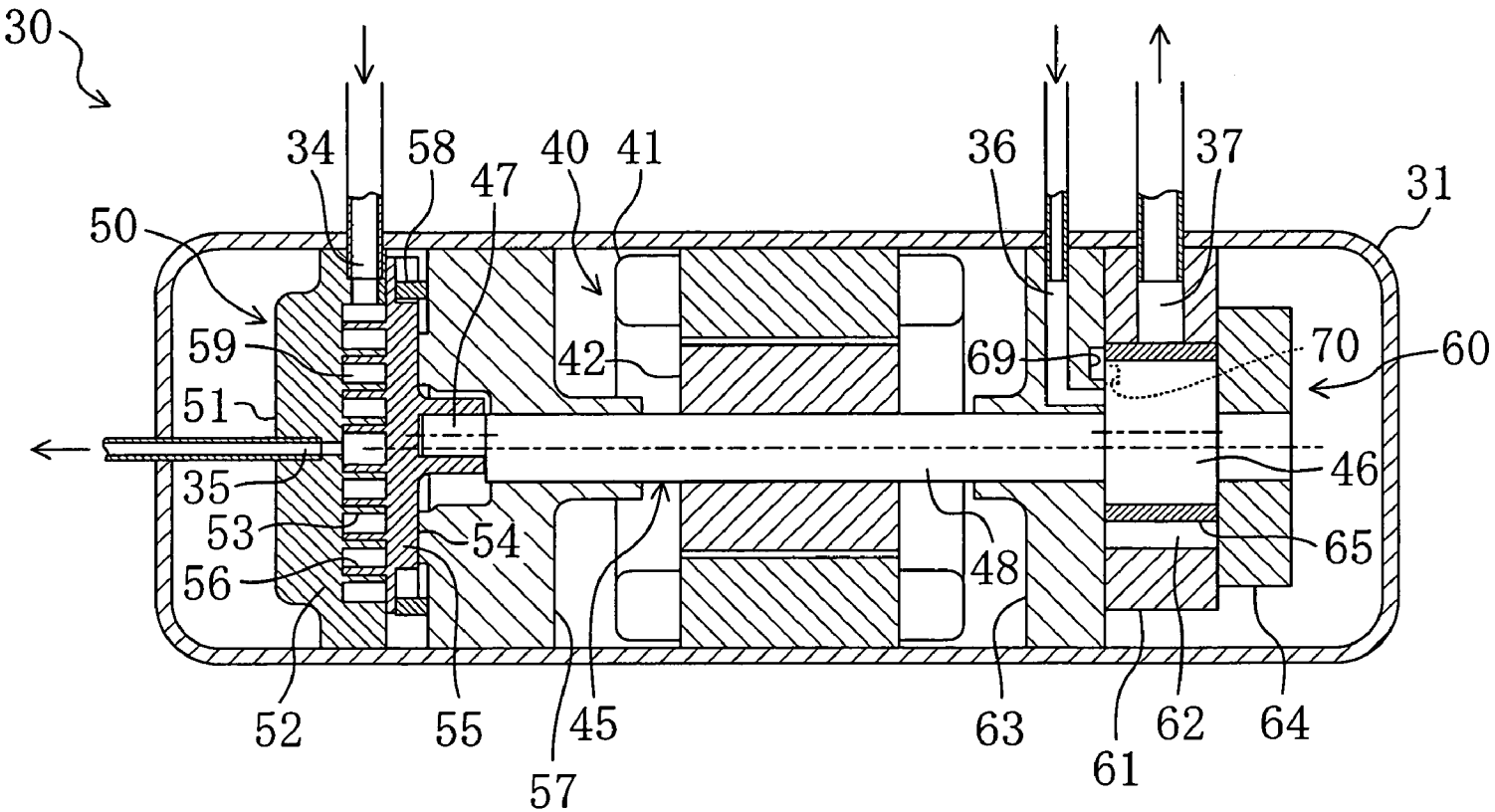
FIG. 2 is a schematic sectional view of a compression/expansion unit according to embodiment 1.

As shown in FIG. 2, the compression/expansion unit (30) constitutes the fluid machinery according to the present invention. The compression/expansion unit (30) houses the compression mechanism (50), the expansion mechanism (60), and the motor (40) in the casing (31) which is a horizontally long cylindrical enclosed container. The compression mechanism (50), the motor (40), and the expansion mechanism (60) are also disposed in this order in the casing (31) from left to right in FIG. 2. It is noted that "left" and "right" used in the following description referring to FIG. 2 respectively stand for "left" and "right" in FIG. 2.

The above-mentioned motor (40) is disposed in the center of the casing (31) in the longitudinal direction. The motor (40) includes a stator (41) and a rotor (42). The stator (41) is fixed to the above-mentioned casing (31). The rotor (42) is disposed inside the stator (41). Besides, a main spindle portion (48) of a shaft (45) coaxially passes through the rotor (42).

A large diameter eccentric portion (46) is formed on the right end of the above-mentioned shaft (45), and a small diameter eccentric portion (47) is formed on its left end. The large diameter eccentric portion (46) is formed with its diameter larger than that of the main spindle portion (48) and is formed in an eccentric manner relative to the shaft center of the main spindle portion (48) by a predetermined degree. On the one hand, the small diameter eccentric portion (47) is formed with its diameter smaller than that of the main spindle portion (48) and is formed in an eccentric manner relative to the shaft center of the main spindle portion (48) by a predetermined degree. The shaft (45) constitutes the axis of rotation.

The above-mentioned shaft (45) is connected with an oil pump, not shown. Besides, lubricating oil is reserved at the bottom of the above-mentioned casing (31). The lubricating oil is pumped up by the oil pump and supplied to the compression mechanism (50) and the expansion mechanism (60) for use in lubrication.

The above-mentioned compression mechanism (50) constitutes what is called a scroll compressor. The compression mechanism (50) is equipped with a fixed scroll (51), a movable scroll (54), and a frame (57). The compression mechanism (50) is also provided with the above-mentioned suction port (34) and the discharge port (35).

In the above-mentioned fixed scroll (51), a whorl fixed side lap (53) is projectingly provided on an end plate (52). The end plate (52) of the fixed scroll (51) is fixed to the casing (31). On the one hand, in the above-mentioned movable scroll (54), a whorl movable side lap (56) is projectingly provided on a plate-like end plate (55). The fixed scroll (51) and the movable scroll (54) are disposed oppositely to each other. Engagement of the fixed side lap (53) and the movable side lap (56) allows the compression chamber (59) to be partitioned.

One end of the above-mentioned suction-port (34) is connected with the outer circumferential side of the fixed side lap (53) and the movable side lap (56). On the other hand, the above-mentioned discharge port (35) is connected with the center of the end plate (52) of the fixed scroll (51), and its one end is opened in the compression chamber (59).

A protruded portion is provided on the center of the right side of the end plate (55) of the above-mentioned movable scroll (54), and the small diameter eccentric portion (47) of the shaft (45) is inserted into the protruded portion. Besides, the above-mentioned movable scroll (54) is supported by a frame (57) through an Oldham's ring (58). The Oldham's ring (58) serves to control the rotation of the movable scroll (54). The movable scroll (54) moves around the shaft center at a predetermined turning radius without rotation. The turning radius of the movable scroll (54) is the same as the degree of eccentricity of the small diameter eccentric portion (47).

The above-mentioned expansion mechanism (60) is what is called a swing piston type expansion mechanism and constitutes the positive displacement expander of the present invention. The expansion mechanism (60) is equipped with a cylinder (61), a front head (63), a rear head (64), and a piston (65). Besides, the expansion mechanism (60) is provided with the above-mentioned inflow port (36) and outflow port (37).

The left side end face of the above-mentioned cylinder (61) is blocked by the front head (63), and its right side end face is blocked by the rear head (64). That is to say, the front head (63) and the rear head (64) each serve as a blocking member.

Figure 4:
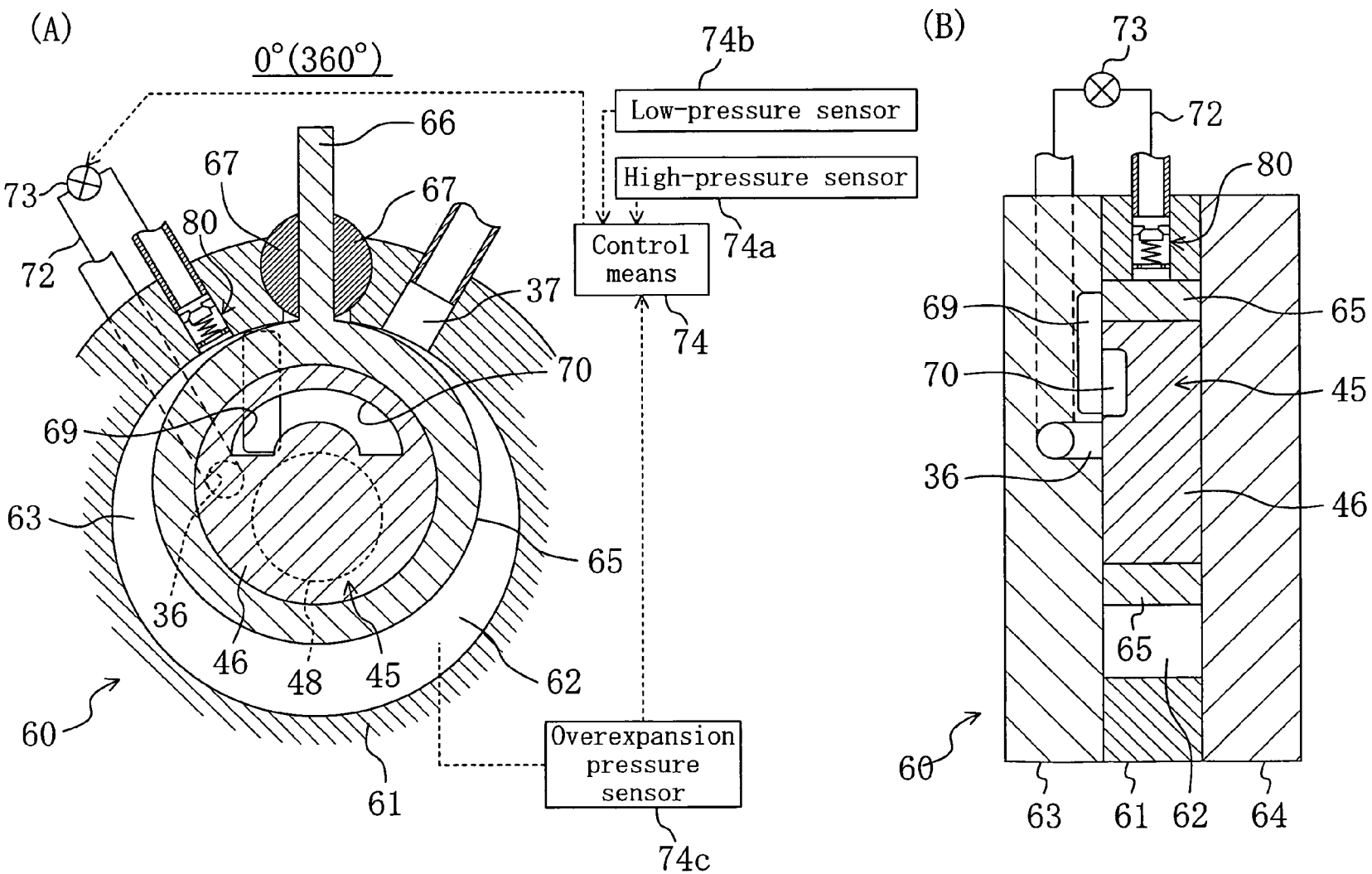
FIG. 4 is a schematic sectional view showing a substantial part of the expansion mechanism according to embodiment 1 with the shaft's angle of rotation being 0° or 360°.

The above-mentioned piston (65) is housed in the cylinder (61), whose the ends are blocked by the front head (63) and the rear head (64). As shown in FIG. 4, the expansion chamber (62) is formed in the cylinder (61), and the outer circumference of the piston (65) has substantially sliding-contact with the inner circumference of the cylinder (61).

As shown in FIG. 4(A), the above-mentioned piston (65) is formed in an annular or cylindrical shape. The inside diameter of the piston (65) is approximately equal to the outside diameter of the large diameter eccentric portion (46). The large diameter eccentric portion (46) of the shaft (45) is provided so as to pass through the piston (65), and the inner circumference of the piston (65) has sliding-contact with an approximately entire outer circumference of the large diameter eccentric portion (46).

The above-mentioned piston (65) is provided integrally with a blade (66). The blade (66) is formed in the form of a plate and protrudes outwards from the outer circumference of the piston (65). The expansion chamber (62), which is sandwiched between the inner circumference of the cylinder (61) and the outer circumference of the piston (65), is partitioned by this blade into the high-pressure side (suction/expansion side) and the low-pressure side (discharge side).

The above-mentioned cylinder (61) is provided with a pair of bushes (67). Each bush (67) is formed in the form of a semicircle. The bushes (67) are disposed sandwiching the blade (66) in between and slide against the blade (66). Moreover, the bushes (67) are rotatable against the cylinder (61) while sandwiching the blade (66) in between.

As shown in FIG. 4, the above-mentioned inflow port (36) is formed in the front head (63) and constitutes an introduction path. The end of the inflow port (36) is opened, on the inner side of the front head (63), at a position where the inflow port (36) does not directly communicate with the expansion chamber (62). Specifically, the end of the inflow port (36) is opened, in the portion having sliding-contact with the end face of the large diameter eccentric portion (46) on the inner side of the front head (63), at a slightly upper position on the left side of the shaft center of the main spindle portion (48) in FIG. 4(A).

A groove-like path (69) is also formed on the front head (63). As shown in FIG. 4(B), the groove-like path (69) is formed in the form of a concave groove which opens on the inner side of the front head (63) by drilling the front head (63) from the inner side.

The opening portion of the groove-like path (69) on the inner side of the front head (63) is in the form of a vertically elongated rectangle in FIG. 4(A). The groove-like path (69) is located on the left side of the shaft center of the main spindle portion (48) in FIG. 4(A). Besides, in FIG. 4(A), the upper end of the groove-like path (69) is located slightly inside the inner circumference of the cylinder (61) and its lower end is located at a portion having sliding-contact with the end face of the large diameter eccentric (46) on the inner side of the front head (63). The groove-like path (69) is communicable with the expansion chamber (62).

A communication path (70) is also formed on the large diameter eccentric portion (46) of the shaft (45). As shown in FIG. 4(B), the communication path (70) is formed in the form of a concave groove which opens on the end face of the large diameter eccentric portion (46) opposite to the front head (63) by drilling the large diameter eccentric portion (46) from the end face side.

Besides, as shown in FIG. 4(A), the communication path (70) is formed in the form of an arc extending along the outer circumference of the large diameter eccentric portion (46). Moreover, the center of the communication path (70) in the circumferential direction is located on the line connecting the shaft center of the main spindle portion (48) with the shaft center of the large diameter eccentric portion (46) and on the other side of the shaft center of the main spindle portion (48) relative to the shaft center of the large diameter eccentric portion (46). When the shaft (45) rotates, the communication path (70) of the large diameter eccentric portion (46) moves accordingly, and then the inflow port (36) intermittently communicates with the groove-like path (69) via the communication path (70).

As shown in FIG. 4(A), the above-mentioned inflow port (37) is formed in the cylinder (61). The inner end of the inflow port (37) opens on the inner circumference of the cylinder (61) facing the expansion chamber (62). The inner end of the inflow port (37) opens close to the right side of the blade (66) in FIG. 4(A).

Moreover, the above-mentioned expansion mechanism (60) is provided with the communication pipe (72) as a communication path which diverges from the inflow port (36), which is the fluid inflow side in the expansion chamber (62), and communicates with a position of the suction/expansion process of the expansion chamber (62). The communication pipe (72) is provided with the circulation control mechanism (73) for switching between circulation and stop of the refrigerant flowing through the communication pipe (72) and regulating a flow rate, and the backflow prevention mechanism (80) for preventing the fluid from flowing from the expansion chamber (62) into the communication pipe (72).

The above-mentioned communication pipe (72) is connected close to the left side of the blade (66) in FIG. 4(A). Specifically, the above-mentioned communication pipe (72) is connected with a part thereof being passed through the cylinder (61) at the position of approximately 20° to 30° in the counterclockwise direction in FIG. 4(A) with the center of rotation of the bushes (67) being assumed 0° based on the center of rotation of the shaft (45).

The above-mentioned circulation control mechanism (73) is provided at a position of the above-mentioned communication pipe (72) outside the cylinder (61). The circulation control mechanism (73) is comprised of an electric-operated valve (injection valve) capable of adjusting the degree of opening. The electric-operated valve (73) is configured to be able to regulate a flow rate of the refrigerant flowing through the above-mentioned communication pipe (72) by adjusting the degree of opening.

The above-mentioned backflow prevention mechanism is comprised of the non-return valve (80). The non-return valve (80) is provided at a position of the communication pipe (72) inside the cylinder (61). The non-return valve (80) is disposed on the expansion chamber (62) side rather than the electric-operated valve (73) and close to the expansion chamber (62).

Figure 12:
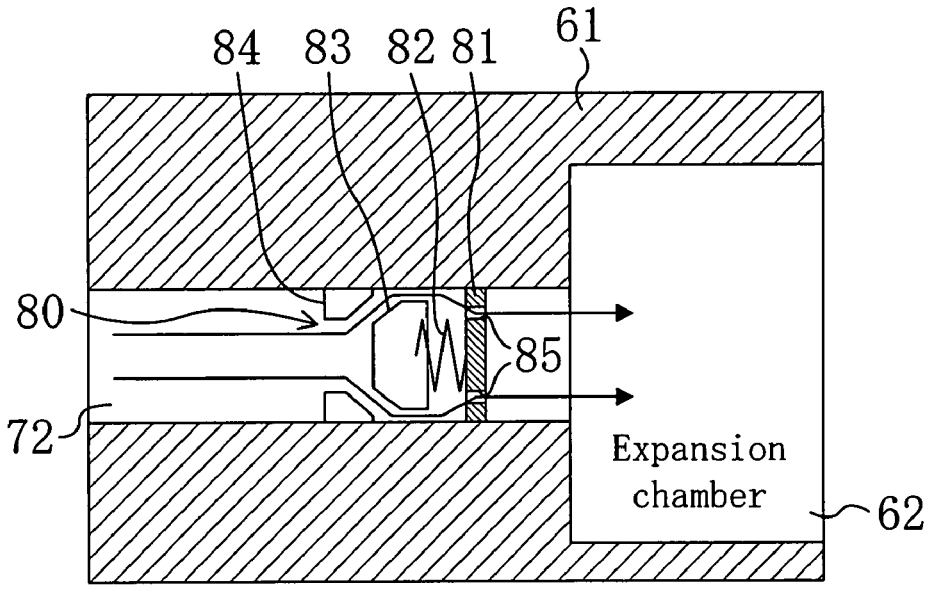
FIG. 12 is a substantial part enlarged sectional view of a backflow prevention mechanism according to embodiment 1. This view is a graph showing a relationship between volume and pressure of an expansion chamber under the operating condition of design pressure.
Figure 12:
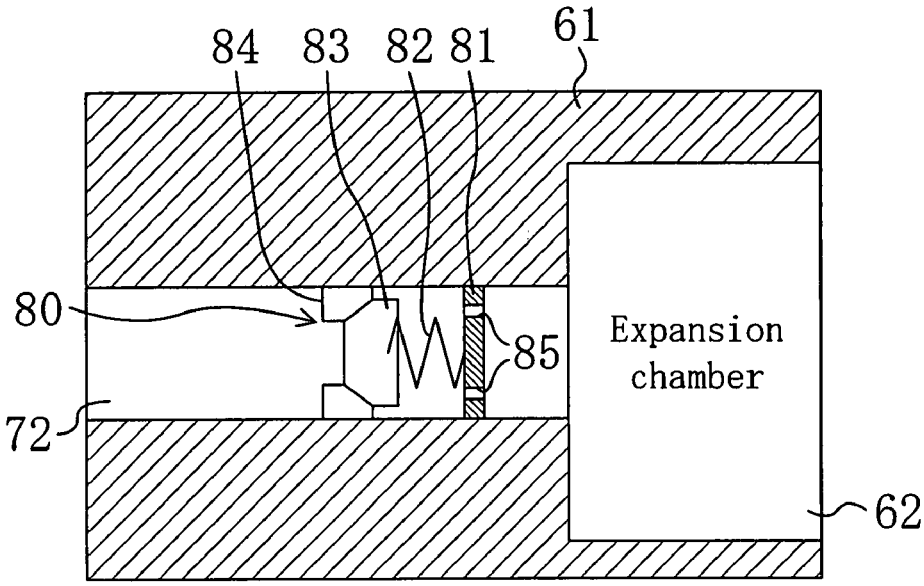
Figure 13:
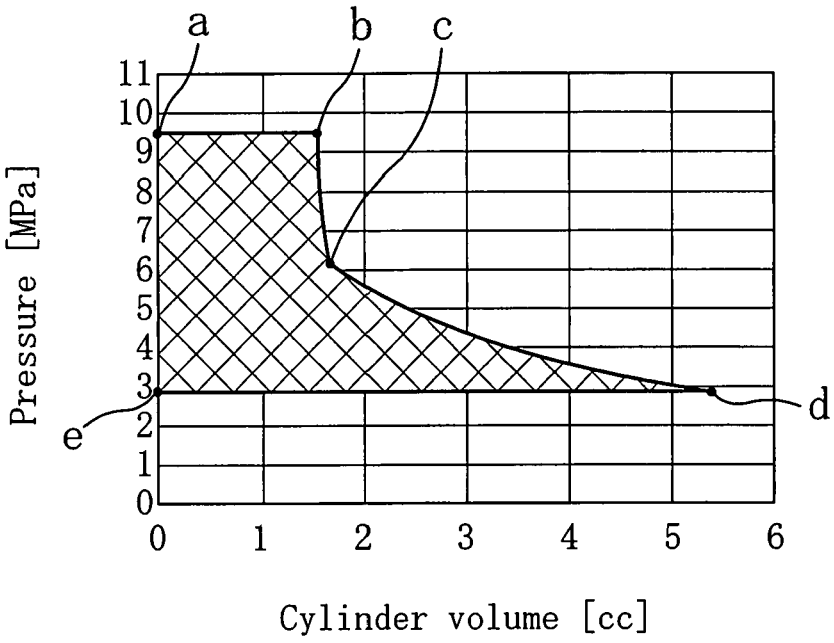
FIG. 13 is a graph showing a relationship between volume and pressure of the expansion chamber under an ideal state.

More specifically, as shown in FIG. 12, the non-return valve (80) is comprised of a support (81), a coil spring (82), a valve element (83), and a valve seat (84). The support (81) is fixed to and supported by the inside wall of the communication pipe (72). A plurality of circulation holes (85) are formed on the support (81). One end of the coil spring (82) is supported by the above-mentioned support (81) on the side opposite to the expansion chamber (62), and the other end of the coil spring (82) supports the above-mentioned valve element (83). The valve element (83) is comprised of a ball type valve element which is formed in the form of approximately semi-circular or trapezoidal cylinder. The valve seat (84) is fixed to and supported by the communication pipe (72) so as to be located close to the tip of the valve element (83). The valve element (83) biased by the above-mentioned coil spring (82) to come into contact with the valve seat (84). By this structure, the non-return valve (80) is configured to allow the fluid to flow from the communication pipe (72) into the expansion chamber (62) while inhibiting the fluid from flowing from the expansion chamber (62) into the communication pipe (72).

As shown in FIG. 4, the air conditioner (10) of embodiment 1 is provided with the overexpansion pressure sensor (74*c*) for detecting the pressure in the expansion chamber (62), in addition to the high-pressure sensor (74*a*) and the low-pressure sensor (74*b*), which are generally disposed in the refrigerant circuit (20). The control means (74) of the air conditioner (10) is adapted to control the above-mentioned electric-operated valve (73) on the basis of the pressure detected by these sensors (74*a*,74*b*,74*c*).

—Operation—

The operation of the above-mentioned air conditioner (10) will be described. Here description is made of the operation of the air conditioner (10) during the cooling operation and the heating operation, and subsequently of the operation of the expansion mechanism (60).

<<Cooling Operation>>

During the cooling operation, the first four-way switching valve (21) and the second four-way switching valve (22) are each switched to the state indicated by the broken line shown in FIG. 1. When power is applied to the motor (40) of the compression/expansion unit (30) in this state, the $CO_2$ refrigerant circulates in the refrigerant circuit (20) to carry out the vapor compression type refrigeration cycle (super-critical cycle).

The refrigerant compressed by the compression mechanism (50) is discharged from the compression/expansion unit (30) through the discharge port (35). In this state, the pressure of the refrigerant is higher than its critical pressure. The discharged refrigerant is fed through the first four-way switching valve (21) to the outdoor heat exchanger (23). In the outdoor heat exchanger (23), heat exchange is carried out between the in-flowing refrigerant and outdoor air fed by the outdoor fan (12). Through this heat exchange, the refrigerant dissipates heat in the outdoor air.

The refrigerant which has dissipated heat in the outdoor heat exchanger (23) passes through the second four-way switching valve (22) and then through the inflow port (36) and flows into the expansion mechanism (60) of the compression/expansion unit (30). In the expansion mechanism (60), the high-pressure refrigerant is expanded and its internal energy is converted into the rotation power of the shaft (45). The low-pressure refrigerant after expansion passes flows out of the compression/expansion unit (30) through the outflow port (37), and passes through the second four-way switching valve (22) and is sent to the indoor heat exchanger (24).

In the indoor heat exchanger (24), heat exchange is carried out between the in-flowing refrigerant and indoor air fed by the indoor fan (14). Through this heat exchange, the refrigerant absorbs the heat from the indoor air and evaporates, thereby cooling the indoor air. The low-pressure gas refrigerant out of the indoor heat exchanger (24) passes through the first four-way switching valve (21) and then through the suction port (34) to be absorbed into the compression mechanism (50) of the compression/expansion unit (30). The compression mechanism (50) compresses the absorbed refrigerant and discharges it.

<<Heating Operation>>

During the heating operation, the first four-way switching valve (21) and the second four-way switching valve (22) are each switched to the state indicated by the solid line shown in FIG. 1. When power is applied to the motor (40) of the compression/expansion unit (30) in this state, the $CO_2$ refrigerant circulates in the refrigerant circuit (20) to carry out the vapor compression type refrigeration cycle (super-critical cycle).

The refrigerant compressed by the compression mechanism (50) is discharged out of the compression/expansion unit (30) through the discharge port (35). In this state, the pressure of the refrigerant is higher than its critical pressure. The discharged refrigerant is fed through the first four-way switching valve (21) to the indoor heat exchanger (24). In the indoor heat exchanger (24), heat exchange is carried out between the in-flowing refrigerant and indoor air. Through this heat exchange, the refrigerant dissipates heat in the indoor air to heat the indoor air.

The refrigerant which has dissipated heat in the indoor heat exchanger (24) passes through the second four-way switching valve (22) and then through the inflow port (36) and flows into the expansion mechanism (60) of the compression/expansion unit (30). In the expansion mechanism (60), the high-pressure refrigerant is expanded and its internal energy is converted into the rotation power of the shaft (45). The low-pressure refrigerant after expansion flows out of the compression/expansion unit (30) through the outflow port (37), and passes through the second four-way switching valve (22) to be sent to the outdoor heat exchanger (23).

In the outdoor heat exchanger (23), heat exchange is carried out between the in-flowing refrigerant and outdoor air, and the refrigerant absorbs heat from the outdoor air and evaporates. The low-pressure gas refrigerant out of the outdoor heat exchanger (23) passes through the first four-way switching valve (21) and then through the suction port (34) to be absorbed into the compression mechanism (50) of the compression/expansion unit (30). The compression mechanism (50) compresses the absorbed refrigerant and discharges it.

<<Operation of Expansion Mechanism>>

Figure 3:
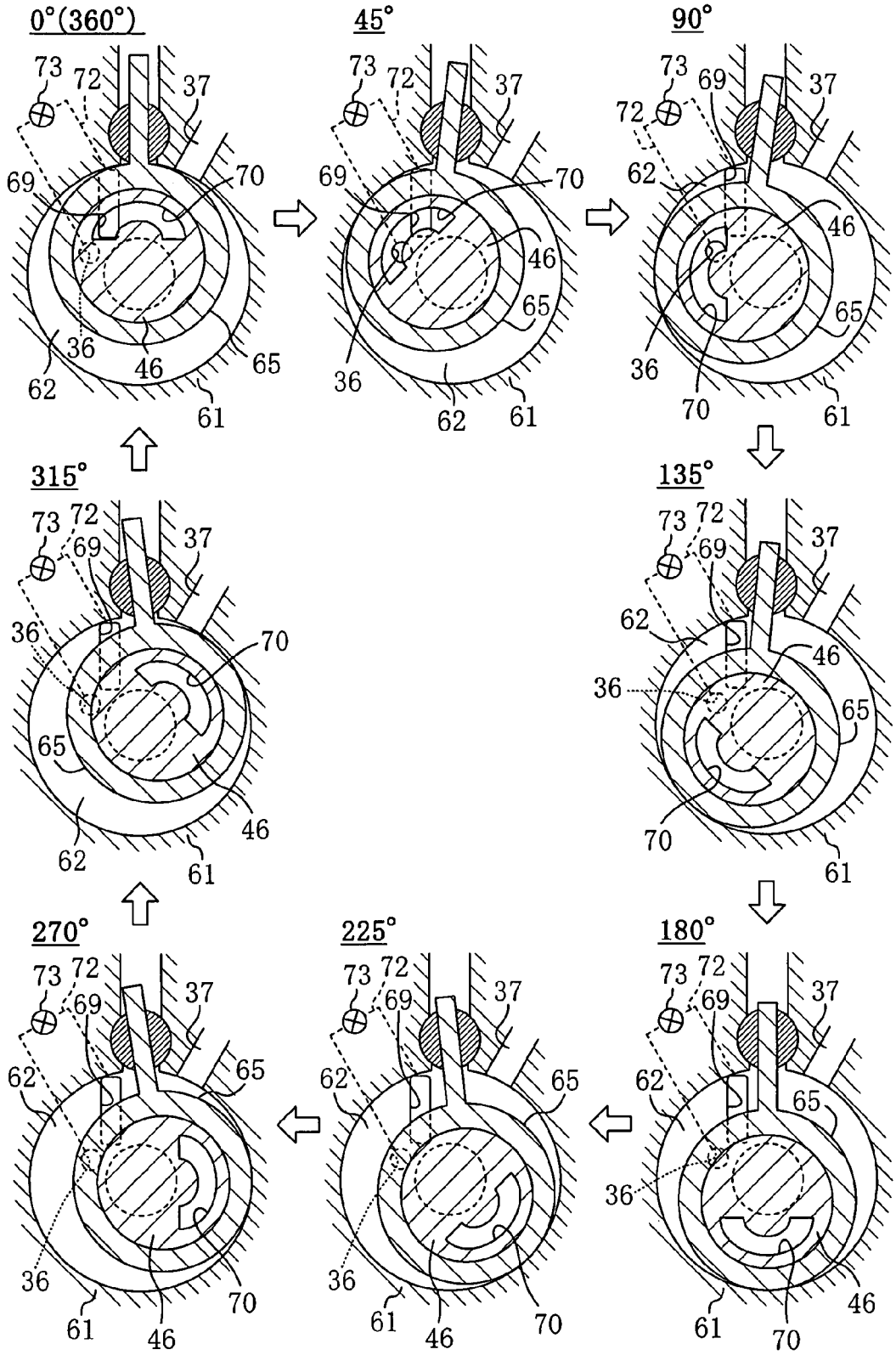
FIG. 3 is a schematic sectional view showing the operation of an expansion mechanism.

Next, the operation of the expansion mechanism (60) will be described by referring to FIGS. 3 to 11. FIG. 3 shows a section of the expansion mechanism (60) perpendicular to the central axis of the large diameter eccentric portion (46) at every 45° rotation of the shaft (45). In FIGS. 4 to 11, those indicated by (A) each show an enlarged section of the expansion mechanism (60) at every angle of rotation in FIG. 3, and those indicated by (B) are views each showing a schematic section of the expansion mechanism (60) along the central axis of the large diameter eccentric portion (46). In FIGS. 4(B) to 11(B), the section of the main spindle portion (48) is omitted.

When the high-pressure refrigerant is introduced into the expansion chamber (62), the shaft (45) turns in the counter-clockwise direction as shown in FIGS. 3 to 11.

As shown in FIGS. 3 and 4, when the angle of rotation of the shaft (45) is 0°, the end of the inflow port (36) is covered with the end face of the large diameter eccentric portion (46). That is to say, the inflow port (36) is in the state of being blocked by the large diameter eccentric portion (46). On the one hand, the communication path (70) of the large diameter eccentric portion (46) is in the state of communication only with the groove-like path (69). The groove-like path (69) is covered by the end face of the piston (65) and the large diameter eccentric portion (46), and thus in the state of non-communication with the expansion chamber (62). The entire expansion chamber (62) is on the low-pressure side by communicating with the outflow port (37). At this time, since the expansion chamber (62) is in the state of being blocked from the inflow port (36), the high-pressure refrigerant does not flow into the expansion chamber (62).

Figure 5:
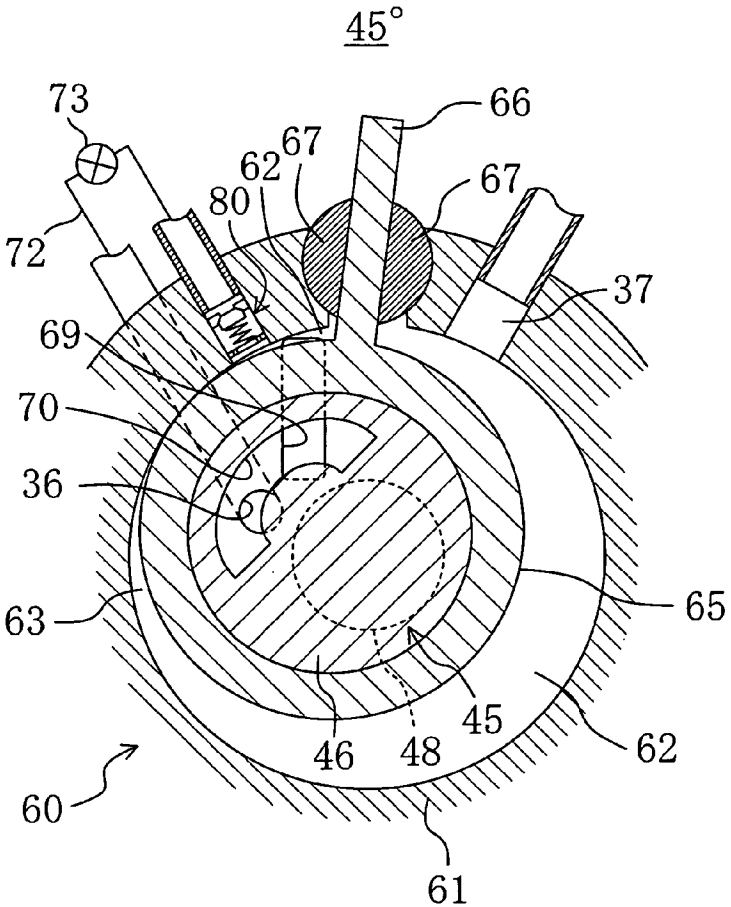
FIG. 5 is a schematic sectional view showing a substantial part of the expansion mechanism according to embodiment 1 with the shaft's angle of rotation being 45°.
Figure 5:
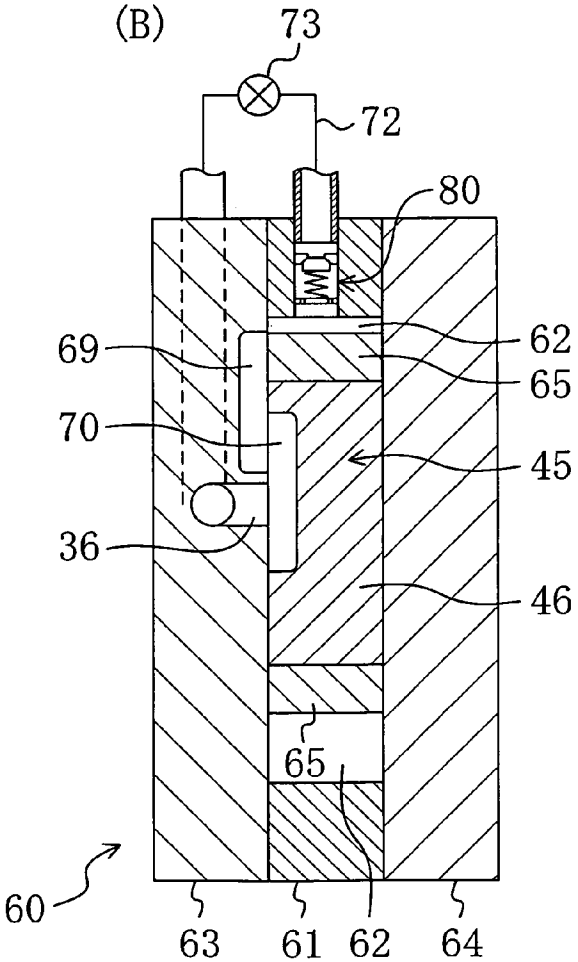

When the angle of rotation of the shaft (45) is 45°, the inflow port (36) is in the state of communication with the communication path (70) of the large diameter eccentric portion (46) as shown in FIGS. 3 and 5. The communication path (70) also communicates with the groove-like path (69). The groove-like path (69) is in the state such that the upper end thereof is off the end face of the piston (65) as shown in FIGS. 3 and 5(A) and communicates with the high-pressure side of the expansion chamber (62). At this time, since the expansion chamber (62) is in the state of communication with the inflow port (36) via the communication path (70) and the groove-like path (69), the high-pressure refrigerant flows into the high-pressure side of the expansion chamber (62). That is to say, introduction of the high-pressure refrigerant into the expansion chamber (62) is started while the angle of rotation of the shaft (45) is from 0° up to 45°.

Figure 6:
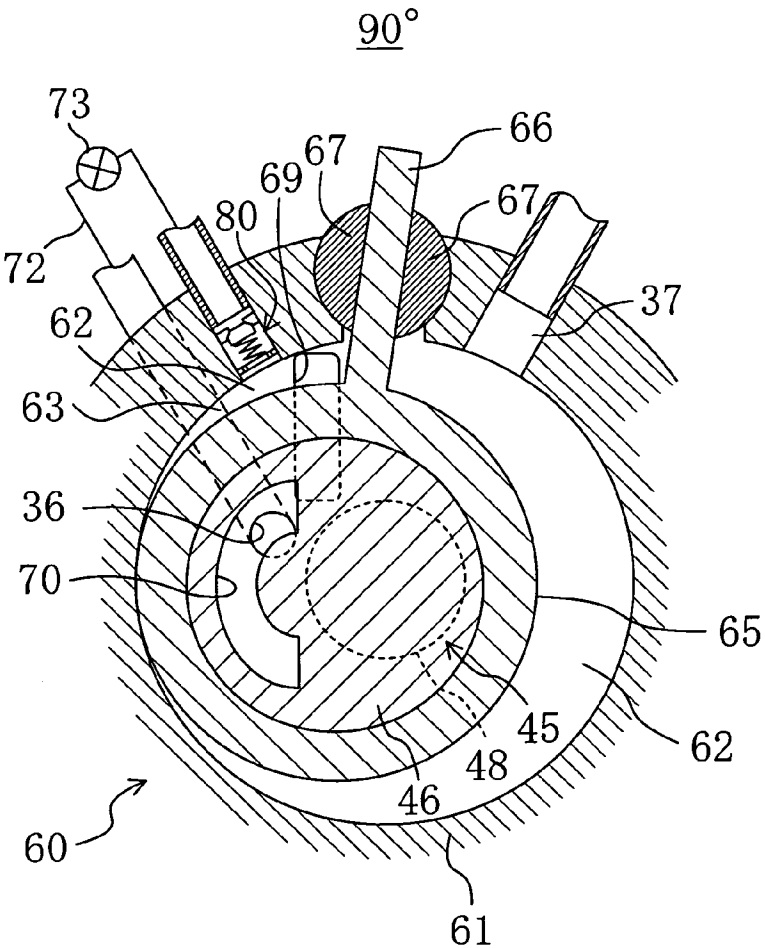
FIG. 6 is a schematic sectional view showing a substantial part of the expansion mechanism according to embodiment 1 with the shaft's angle of rotation being 90°.
Figure 6:
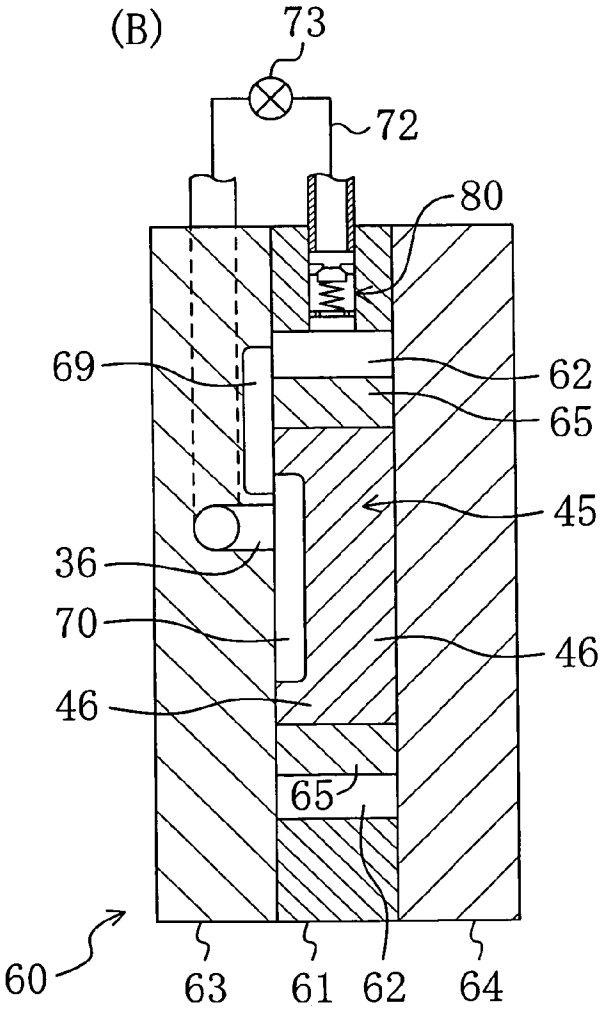

As shown in FIGS. 3 and 6, when the angle of rotation of the shaft (45) is 90°, the expansion chamber (62) remains in the state of communication with the inflow port (36) via the communication path (70) and the groove-like path (69). Thus, while the angle of rotation of the shaft (45) is from 45° up to 90°, the high-pressure refrigerant continues to flow into the high-pressure side of the expansion chamber (62).

Figure 7:
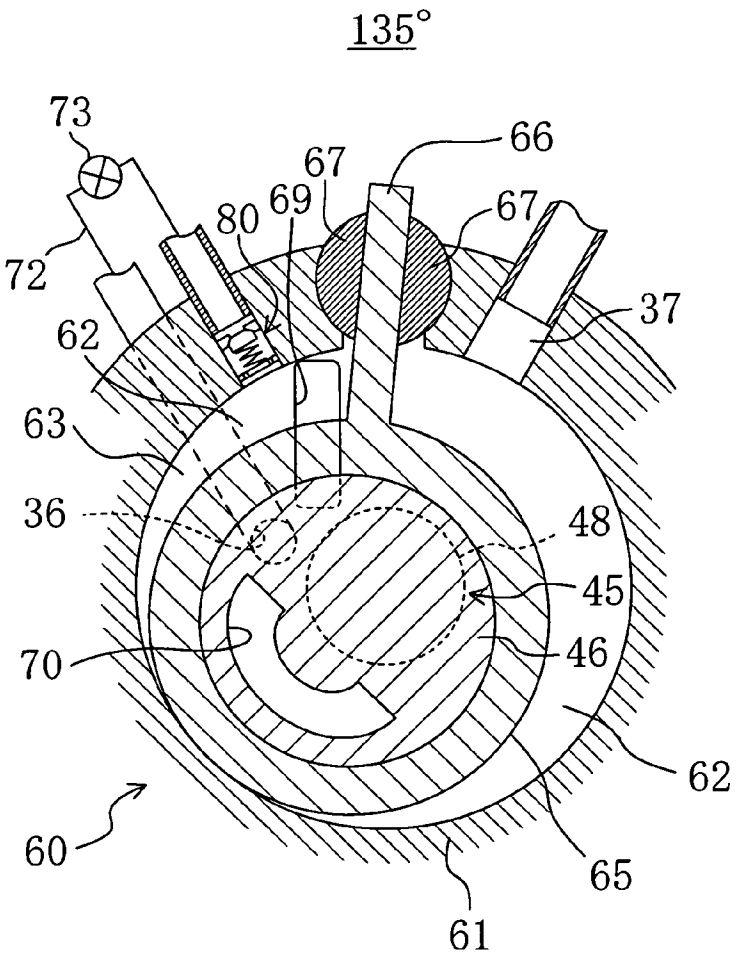
FIG. 7 is a schematic sectional view showing a substantial part of the expansion mechanism according to embodiment 1 with the shaft's angle of rotation being 135°.
Figure 7:
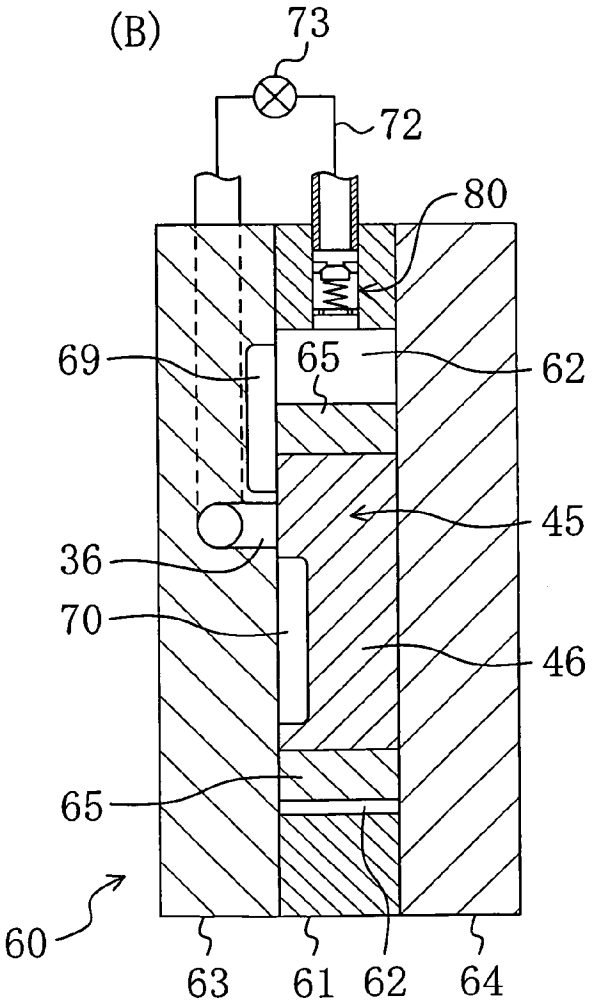
Figure 8:
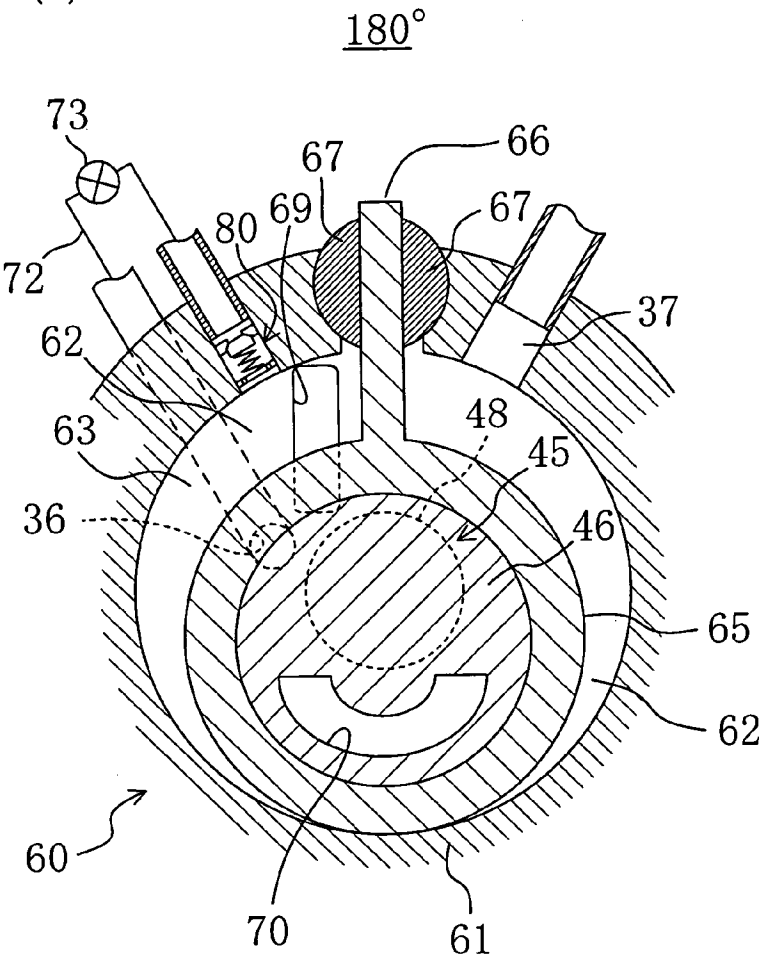
FIG. 8 is a schematic sectional view showing a substantial part of the expansion mechanism according to embodiment 1 with the shaft's angle of rotation being 180°.
Figure 8:
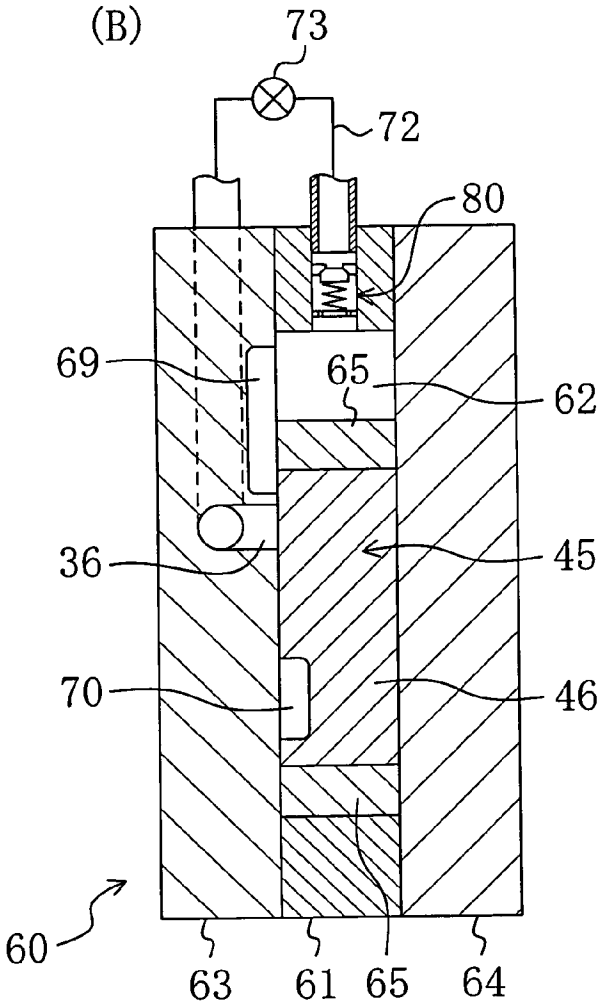
Figure 9:
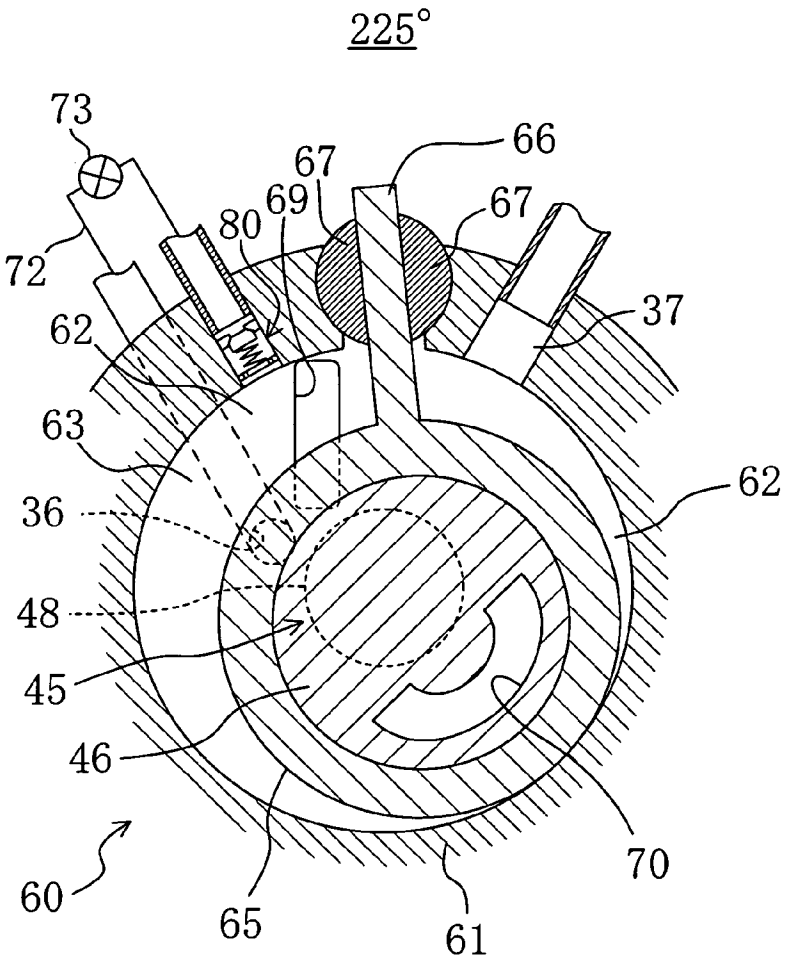
FIG. 9 is a schematic sectional view showing a substantial part of the expansion mechanism according to embodiment 1 with the shaft's angle of rotation being 225°.
Figure 9:
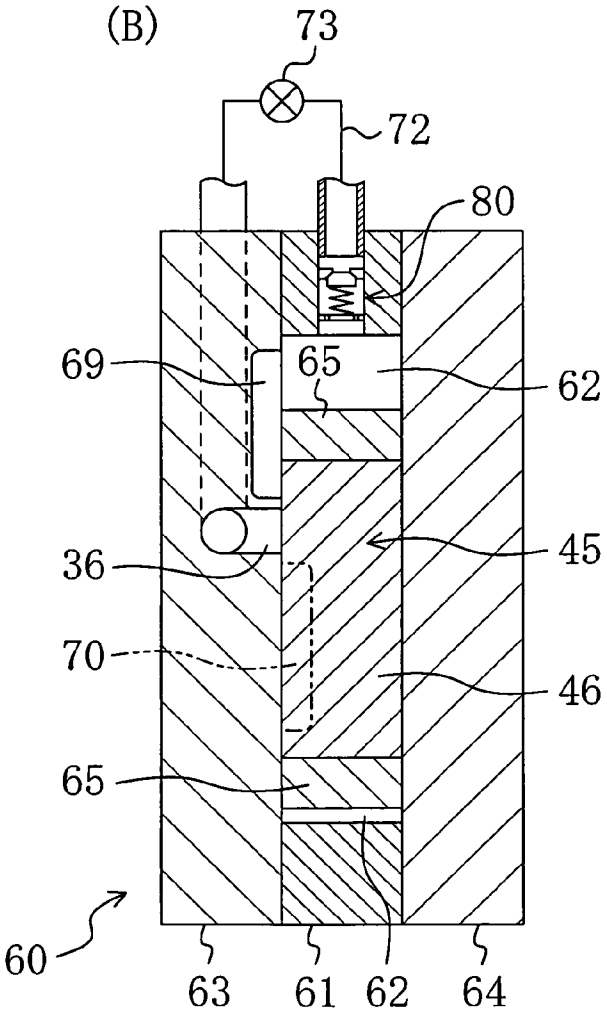
Figure 10:
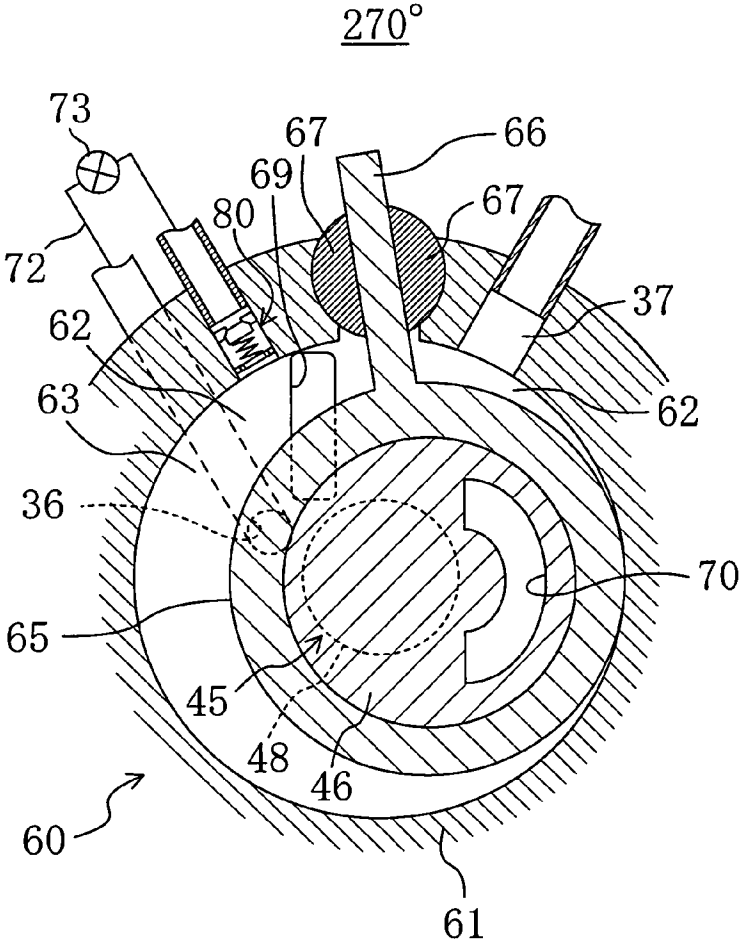
FIG. 10 is a schematic sectional view showing a substantial part of the expansion mechanism according to embodiment 1 with the shaft's angle of rotation being 270°.
Figure 10:
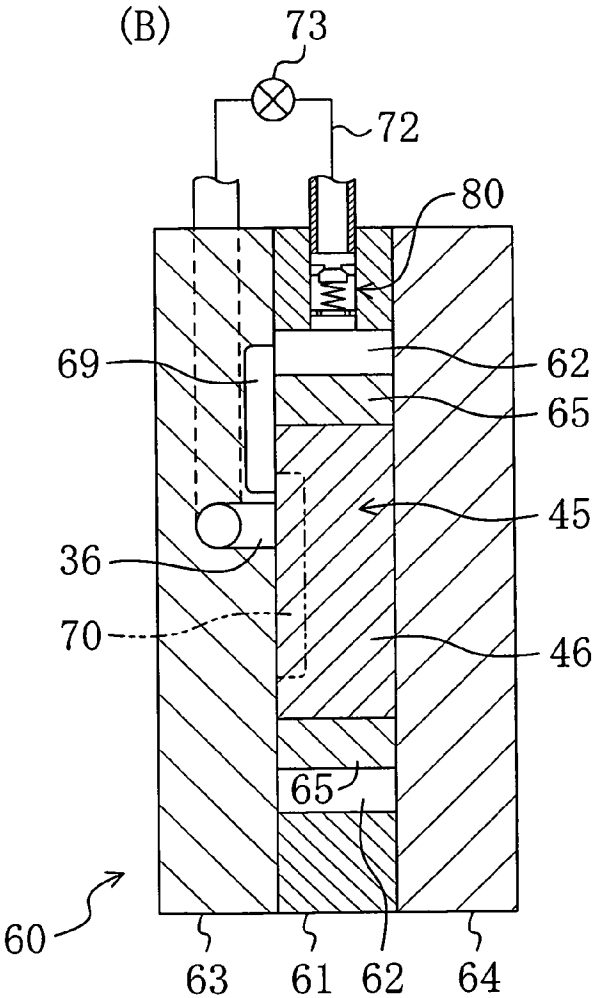
Figure 11:
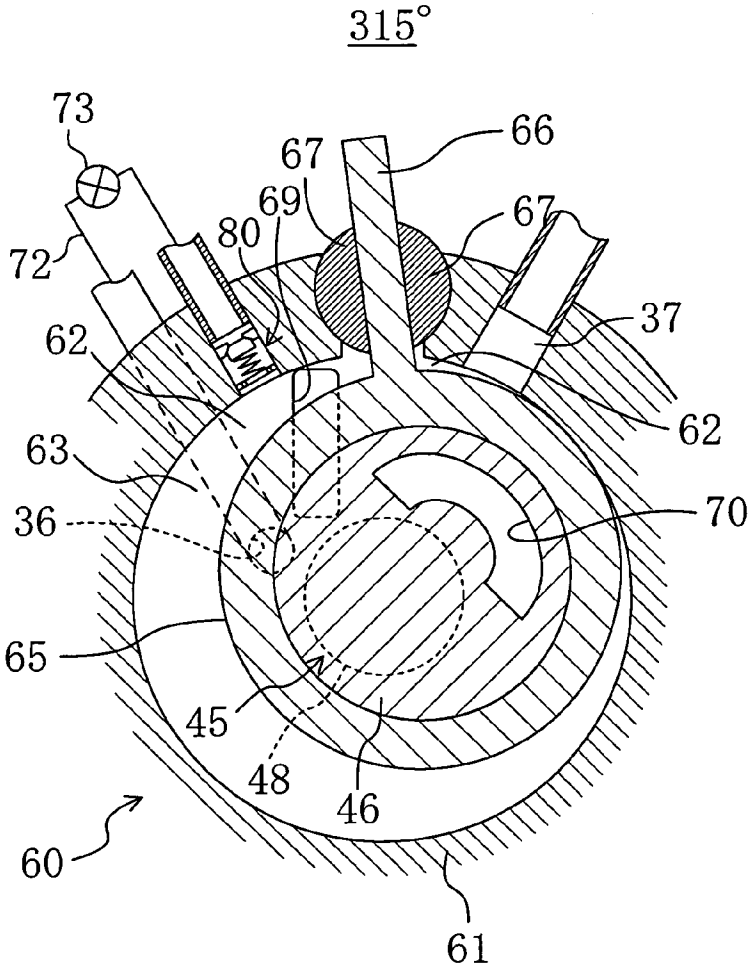
FIG. 11 is a schematic sectional view showing a substantial part of the expansion mechanism according to embodiment 1 with the shaft's angle of rotation being 315°.
Figure 11:
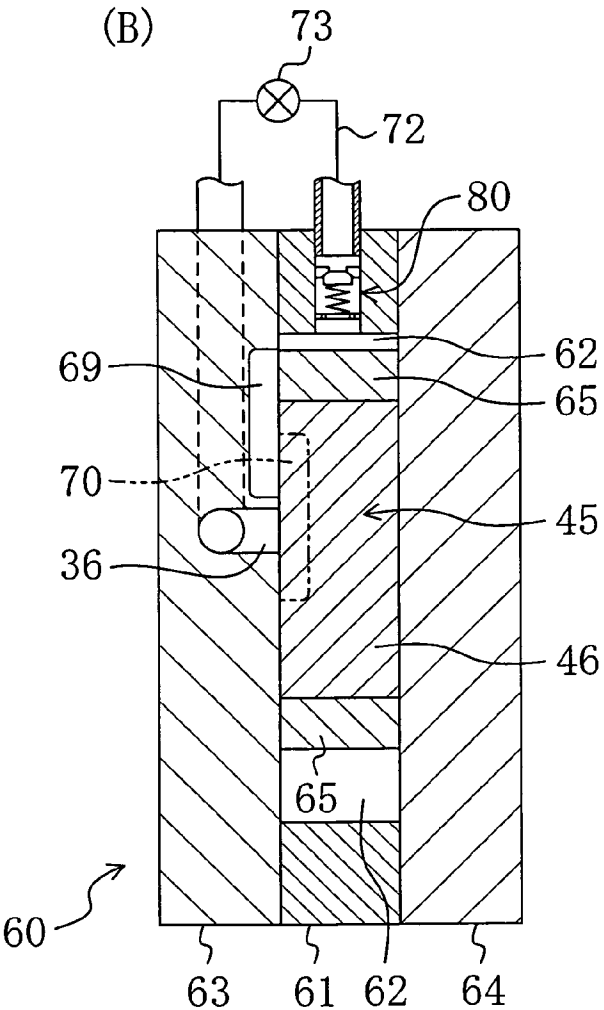

As shown in FIGS. 3 and 7, when the angle of rotation of the shaft (45) is 135°, the communication path (70) of the large diameter eccentric portion (46) is in the state of non-communication with both the groove-like path (69) and the inflow port (36). At this time, since the expansion chamber (62) is in the state of being blocked from the inflow port (36), the high-pressure refrigerant does not flow into the expansion chamber (62). Thus, introduction of the high-pressure refrigerant into the expansion chamber (62) is terminated while the angle of rotation of the shaft (45) is from 90° up to 135°.

After introduction of the high-pressure refrigerant into the expansion chamber (62) is terminated, the high-pressure side of the expansion chamber (62) becomes a closed space, and the in-flowing refrigerant expands there. That is to say, as shown in FIG. 3 and FIGS. 8 to 11, the shaft (45) turns and the volume of the expansion chamber (62) on the high-pressure side increases. In the meantime, the low-pressure refrigerant after expansion continues to be discharged through the outflow port (37) from the low-pressure side of the expansion chamber (62), which communicates with the outflow port (37).

The refrigerant in the expansion chamber (62) continues to expand until the contact portion of the piston (65) with the cylinder (61) reaches the outflow port (37) while the angle of rotation of the shaft (45) is from 315° up to 360°. When the contact portion of the piston with the cylinder (61) crosses the outflow port (37), the expansion chamber (62) is brought into communication with the outflow port (37) and the expanded refrigerant starts to be discharged.

During the operation of the expansion mechanism (60) in the above manner, the low-pressure of the refrigeration cycle may rise due to switching between the cooling operation and the heating operation in the above-mentioned refrigerant circuit (20) or variation of outside air temperature. Under such conditions, since the pressure (the pressure of the low-pressure refrigerant in FIG. 11(A)) of the refrigerant expanded in the expansion chamber (62) becomes smaller than the low-pressure of the refrigeration cycle, overexpansion loss occurs when the low-pressure refrigerant is discharged. In view of this, in the expansion mechanism (60) according to the present embodiment, the above-mentioned control means (74) carries out the following operation control on the basis of the pressure detected by the above-mentioned sensors (74*a*, 74*b*,74*c*).

Specifically, for example, when the differential pressure between the low-pressure sensor (74*b*) and the overexpansion pressure sensor (74*c*) becomes larger than a predetermined value, the electric-operated valve (73) in the communication pipe (72) is opened to a predetermined degree of opening. As a result, the high-pressure refrigerant diverged from the inflow port (36) circulates through the communication pipe (72). Then, the high-pressure refrigerant passing through the electric-operated valve (73) reaches the non-return valve (80).

When the high-pressure refrigerant reaches the non-return valve (80), the valve element (81) of the non-return valve (80) is pushed toward the expansion chamber (62) by the high-pressure refrigerant as shown in FIG. 12(A). As a result, the valve element (81) is separated from the valve seat (84), and the high-pressure refrigerant passes through both elements. After passing through the circulation holes (85) of the support (81), the high-pressure refrigerant is introduced into the expansion chamber (62). Consequently, the refrigerant pressure of the expansion chamber (62) rises. This almost equalizes the pressure of the refrigerant expanded in the expansion chamber (62) and the low-pressure of the refrigeration cycle, thereby reducing the above-mentioned overexpansion loss.

On the one hand, when the refrigeration cycle is carried out in the refrigerant circuit (20) under the ideal condition, it is not necessary to inject the high-pressure refrigerant from the communication pipe (72) into the expansion chamber (62), and thus, the expansion mechanism (60) carries out normal operation. Accordingly, the electric-operated valve (73) of the communication pipe (72) is totally closed under this condition. Consequently, since the pressure of the high-pressure refrigerant is not acted on the valve element (83) of the non-return valve (80) from the inflow port (36) side, the valve element (83) is in the state of being pushed onto the valve seat (84) by the pushing force of the coil spring (82) as shown in FIG. 12(B). Therefore, the refrigerant is prevented from flowing from the expansion chamber (62) into the communication pipe (72) by the non-return valve (80) when the expansion mechanism (60) is in normal operation.

Effects of Embodiment 1

As described hereinbefore, according to the above-mentioned embodiment 1, under the condition of overexpansion occurring in the expansion chamber (62), the high-pressure refrigerant which is diverged from the inflow port (37) is introduced from the communication pipe (72) into the expansion chamber (62) by opening the electric-operated valve (73) of the communication pipe (72) to a predetermined degree of opening. This raises the pressure of the refrigerant which is expanded in the expansion chamber (62) to eliminate overexpansion. Thus, it is possible to improve the power recovery efficiency of the expansion chamber.

Figure 14:
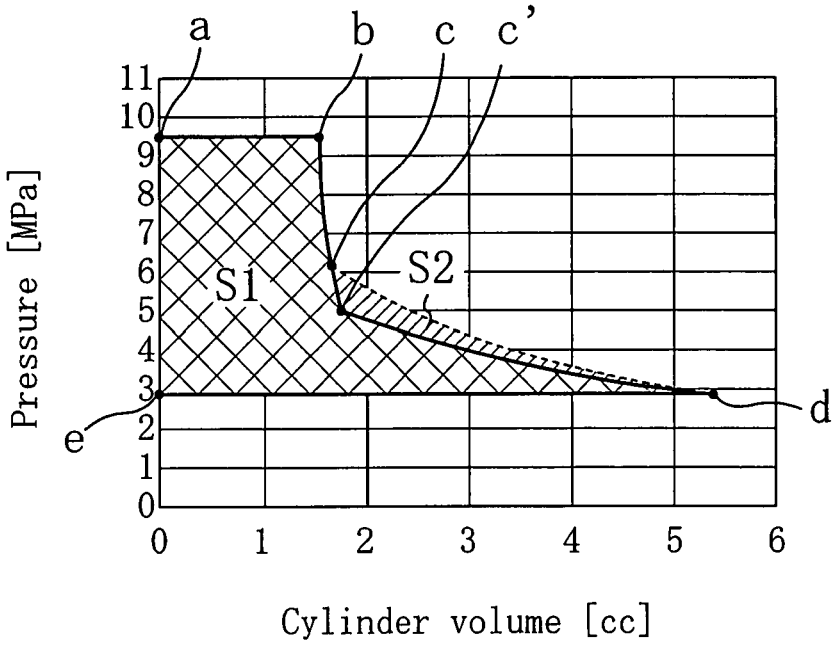
FIG. 14 is a graph showing a relationship between volume and pressure of the expansion chamber when dead volume is formed in the communication path.

On the one hand, when ideal expansion is carried out in the expansion mechanism (60) and operation is carried out with the electric-operated valve (73) closed, the non-return valve (80) prevents the refrigerant from flowing from the expansion chamber (62) to the communication pipe (72). This prevents the volume from the electric-operated valve (73) to the expansion chamber (62) in the communication pipe (72) from becoming dead volume of the expansion chamber (62), which results in a reduction in the pressure of the refrigerant in the expansion process as shown in FIG. 14. Accordingly, when the communication pipe (72) is not provided with the non-return valve (80), which was conventionally the case, the amount of power recovery is equal to the area of S1 shown in FIG. 14. On the contrary, when the communication pipe (72) is provided with the non-return valve (80) as in the present invention, the amount of power recovery equals to the area of S1 plus S2 shown in FIG. 14. That is to say, since the above-mentioned dead volume is restrained by the non-return valve (80) in the expander according to the present invention during normal operation with the electric-operated valve (73) in the state of total closing, it is possible to improve the power recovery efficiency during normal operation.

Besides, in the above-mentioned embodiment 1, the non-return valve (80) is disposed in the communication pipe (72) located inside the cylinder (61) and close to the expansion chamber (62). Accordingly, it is possible to suppress dead volume from occurring in the communication pipe (72) as much as possible. Besides, in the above-mentioned embodiment 1, the electric-operated valve (73) is disposed in the communication pipe (72) located outside the cylinder (61). Accordingly, this facilitates external replacement and maintenance of the electric-operated valve (73), which has a relatively complicated construction.

Furthermore, in the above-mentioned embodiment 1, the expansion mechanism (60) is utilized for the expansion process of the super-critical cycle. Incidentally, since the pressure of the refrigerant flowing into the expander is relatively high in the expansion process of the super-critical cycle, the amount of power recovery tends to be reduced due to the dead volume of the expansion chamber (72). On the one hand, since such dead volume in the expansion chamber (72) is reduced as much as possible by the non-return valve (80) in the present embodiment, it is possible to effectively improve the power recovery efficiency of the expander.

Embodiment 2

Figure 15:
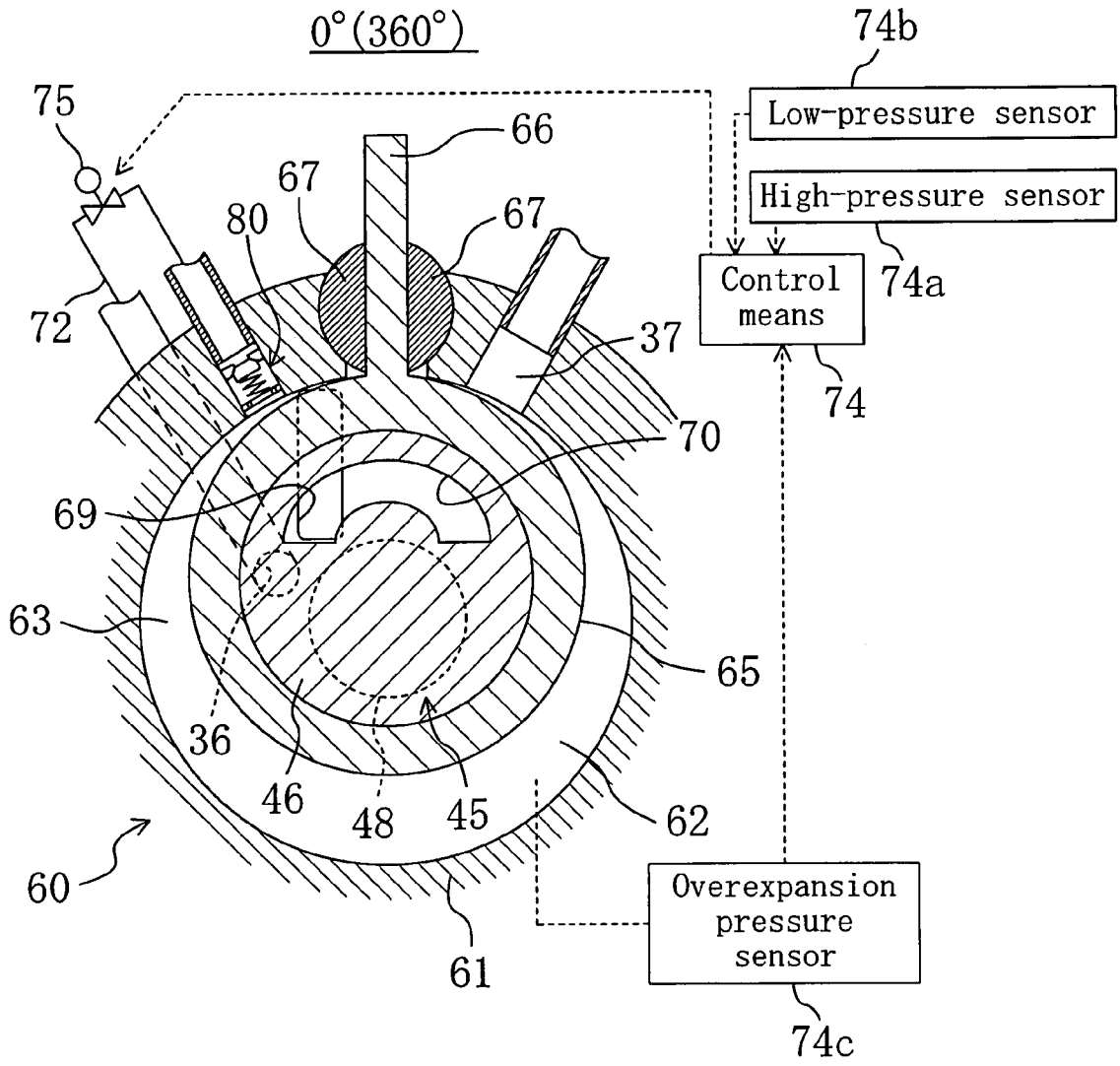
FIG. 15 is a schematic sectional view showing a substantial part of the expansion mechanism according to embodiment 2.

Embodiment 2 of the present invention is an example in which the communication pipe (72) of the expansion mechanism (60) is provided with, instead of the electric-operated valve (73), the electromagnetically opening/closing valve (75) as shown in FIG. 15 capable of opening and closing for the fluid machinery of embodiment 1. The above-mentioned control means (74) is configured to open and close the above-mentioned electromagnetically opening/closing valve (75) at a predetermined timing under the condition such that overexpansion occurs in the expansion chamber (62). The other portions of embodiment 2 are configured similarly to those of embodiment 1 including the above-mentioned backflow prevention mechanism.

In embodiment 2, when overexpansion occurs, it is possible to eliminate the condition of overexpansion by opening the electromagnetically opening/closing valve (75) in the communication pipe (72) at a predetermined timing, thereby raising the pressure of the refrigerant of the expansion chamber (62). Also in embodiment 2, at the time of normal operation with the electromagnetically opening/closing valve (75) in the state of total closing, it is possible to prevent the refrigerant from flowing from the expansion chamber (62) into the communication pipe (72) by means of the non-return valve (80). Accordingly, also in the present embodiment, it is possible to prevent a reduction in the power recovery efficiency due to the dead volume of the expansion chamber (62).

Embodiment 3

Figure 16:
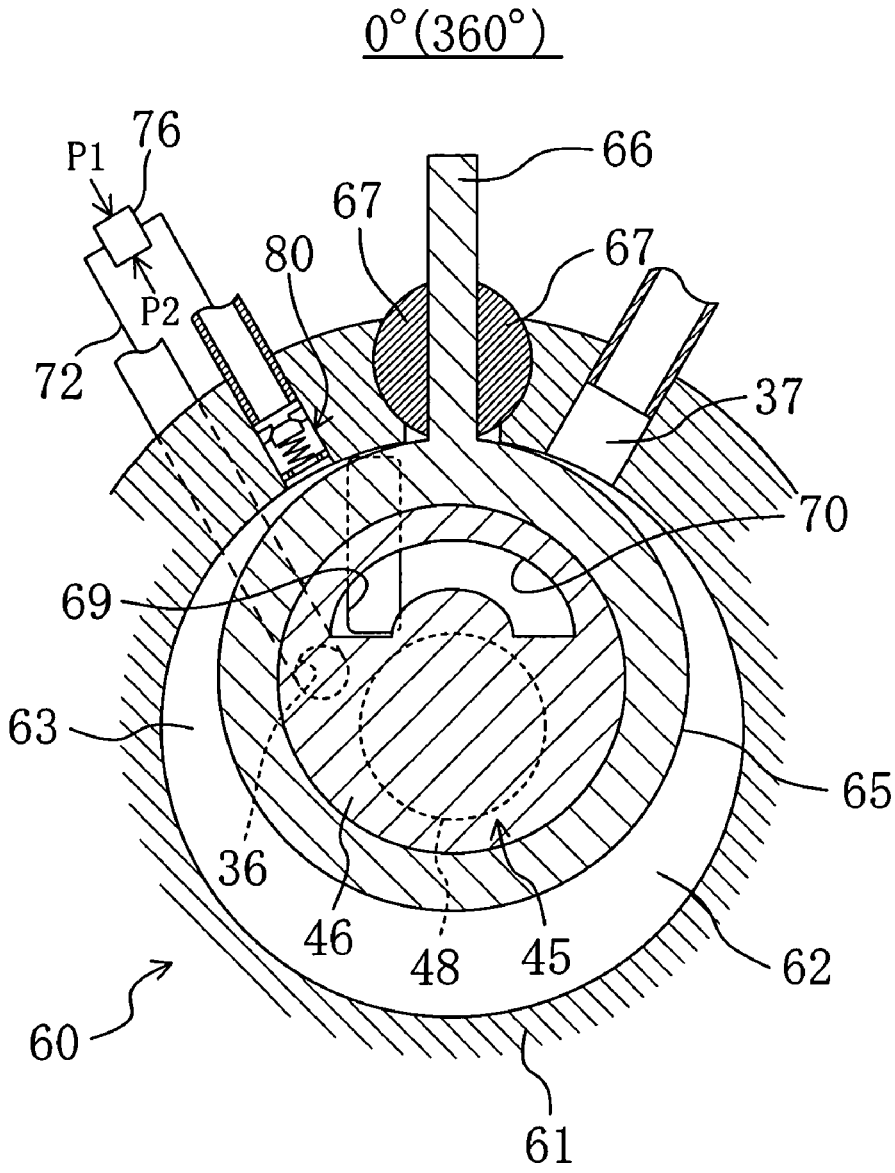
FIG. 16 is a schematic sectional view showing a substantial part of the expansion mechanism according to embodiment 3.

Embodiment 3 of the present invention uses, as the circulation control mechanism provided for the communication pipe (72), the differential pressure valve (76) as shown in FIG. 16, instead of the electric-operated valve (73) of embodiment 1 and the electromagnetically opening/closing valve (75) of embodiment 2. The differential pressure valve (76) is operated when predetermined differential pressure occurs between the pressure of the fluid at the intermediate position during the expansion process of the expansion chamber (62) and the pressure on the outflow side of the fluid. The above-mentioned pressure acts directly on the differential pressure valve (76). Also in embodiment 3, the non-return valve (80) is provided as the backflow prevention mechanism for the communication pipe (72), similarly to the above.

Figure 17:
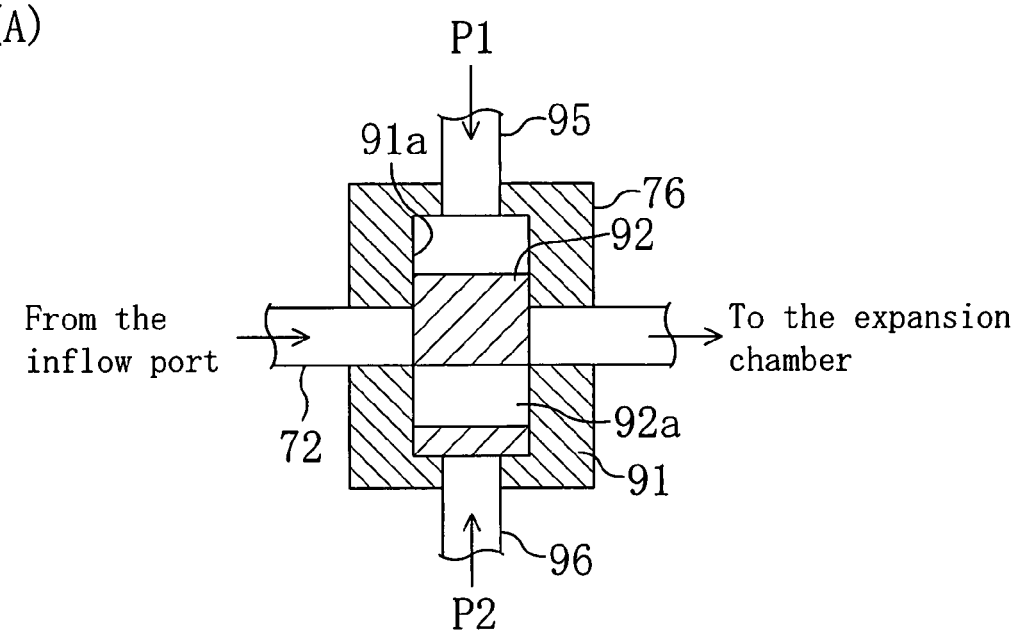
FIG. 17 is a schematic sectional view showing a structure and operation of a differential pressure valve according to embodiment 3.
Figure 17:
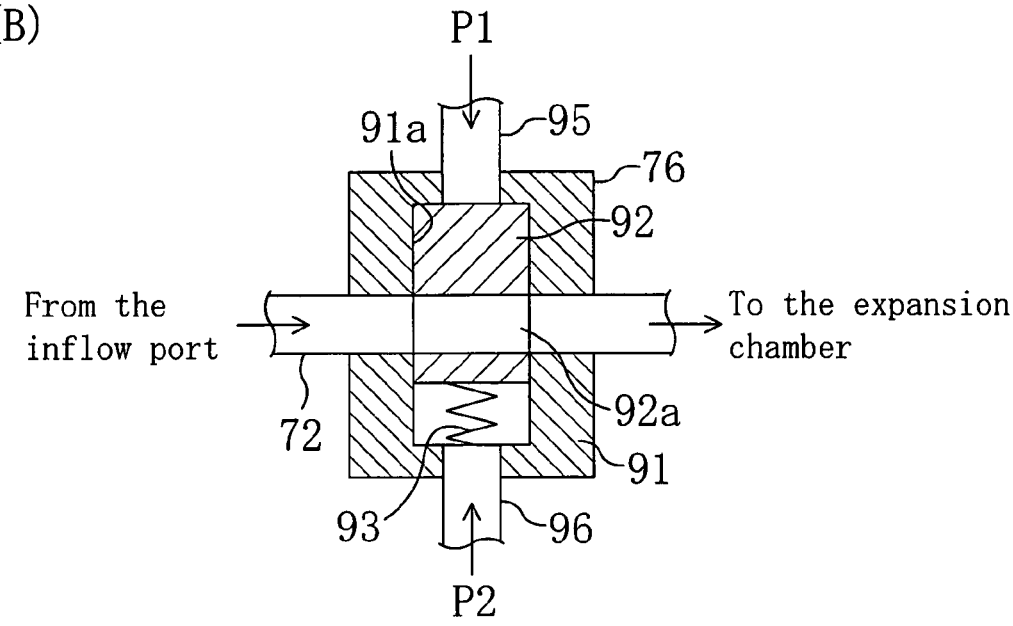

As shown in FIG. 17, the above-mentioned differential pressure valve (76) is comprised of a valve case (91) fixed in the passage of the above-mentioned communication pipe (72), a valve element (92) movably provided in the valve case (91), and a spring (93) (See FIG. 17(B)) for biasing the valve element (92) in one direction. The valve case (91) is a hollow member in which a housing concave portion (91*a*) for slidably retaining the above-mentioned valve element (92) is formed, and provided with four ports communicating with the housing concave portion (91*a*). The above-mentioned valve element (92) can be displaced to the closing position (FIG. 17(A) position) for closing the above-mentioned communication pipe (72) and to the opening position (FIG. 17(B) position) for opening the communication pipe (72), and biased from the opening position to the closing position by means of the above-mentioned spring (93).

The above-mentioned communication pipe (72) is fixed to the above-mentioned valve case (91) in the direction orthogonal to the direction of movement of the valve element (92) in the above-mentioned valve case (91). The valve element (92) is engaged with the housing concave portion (91*a*) of the valve case (91) and slidably formed between the above-mentioned closing position and the opening position. Besides, the valve element (92) has a communication hole (92*a*) which opens the above-mentioned communication pipe (72) at the opening position and closes the communication pipe (72) at the closing position.

A first communication pipe (95) for communicating with the expansion process intermediate position of the expansion chamber (62) and a second communication pipe (96) for communicating with the outflow port (37), which is on the fluid outflow side, are connected with the above-mentioned valve case (91). The first communication pipe (95) is connected with the above-mentioned valve case (91) at the end opposite to the spring (93), that is, at the end on the opening position side of the valve element (92) so that the pressure P1 is given from the expansion chamber (62) to the valve element (92). The second communication pipe (96) is connected with the above-mentioned valve case (91) at the end on the spring (93) side, that is, at the end on the closing position side of the valve element (92) so that the pressure P2 (the low-pressure of the refrigeration cycle) is given from the fluid outflow side to the valve element (92). Accordingly, when the pressure on the fluid outflow side rises rather than the pressure in the expansion chamber (62) and larger differential pressure than a predetermined value occurs between the pressure P1 and P2, then the above-mentioned differential pressure valve (76) is operated.

In embodiment 3, when, for example, the pressure P2 of the outflow port (37), which is the low-pressure of the refrigeration cycle, grows larger than the pressure P1 in the expansion chamber (62) and thus the differential pressure between both pressure P1 and P2 grows larger than a predetermined value, the differential pressure valve (76) is opened. Accordingly, a part of the refrigerant on the inflow side is introduced through the communication pipe (72) into the expansion chamber (62). As a result, the pressure in the expansion chamber (62) is raised, thereby eliminating overexpansion.

On the other hand, when the expansion mechanism (60) is operated under the ideal condition, no substantial differential pressure is produced between the outflow port (37) and the expansion chamber (62) of the expansion mechanism (60), and thus the differential pressure valve (76) is in the closed state. As shown in FIG. 16, also in embodiment 3, the non-return valve (80), which is the backflow prevention mechanism, prevents the refrigerant from flowing from the expansion chamber (62) into the communication pipe (72). Accordingly, it is possible to reduce the dead volume of the expansion chamber (62) and carry out operation with a high power recovery efficiency.

Embodiment 4

Embodiment 4 of the present invention is a modification of the configuration of the expansion mechanism (60) according to the above-mentioned embodiment 1. Specifically, the expansion mechanism (60) of the above-mentioned embodiment 1 is configured as the oscillating piston type, whereas the expansion mechanism (60) of embodiment 4 is configured as the swing piston type. Here different points of the expansion mechanism (60) of embodiment 4 from the above-mentioned embodiment 1 will be described.

Figure 18:
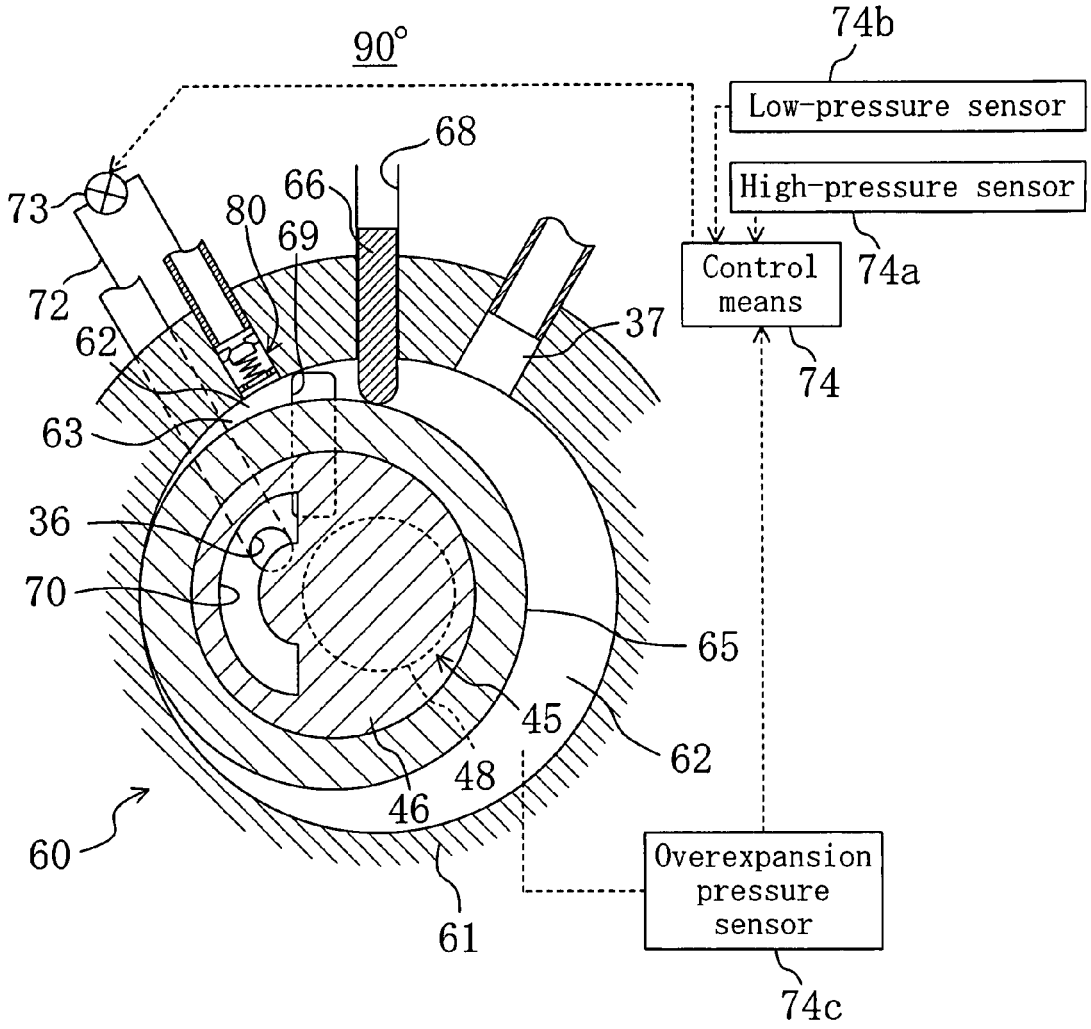
FIG. 18 is a schematic sectional view showing a substantial part of the expansion mechanism according to embodiment 4.

As shown in FIG. 18, in embodiment 4, the blade (66) is formed separately from the piston (65). That is to say, the piston (65) according to embodiment 4 is formed in the form of simple annular ring or cylinder. Besides, the blade groove (68) is formed in the cylinder (61) according to embodiment 4.

Figure 19:
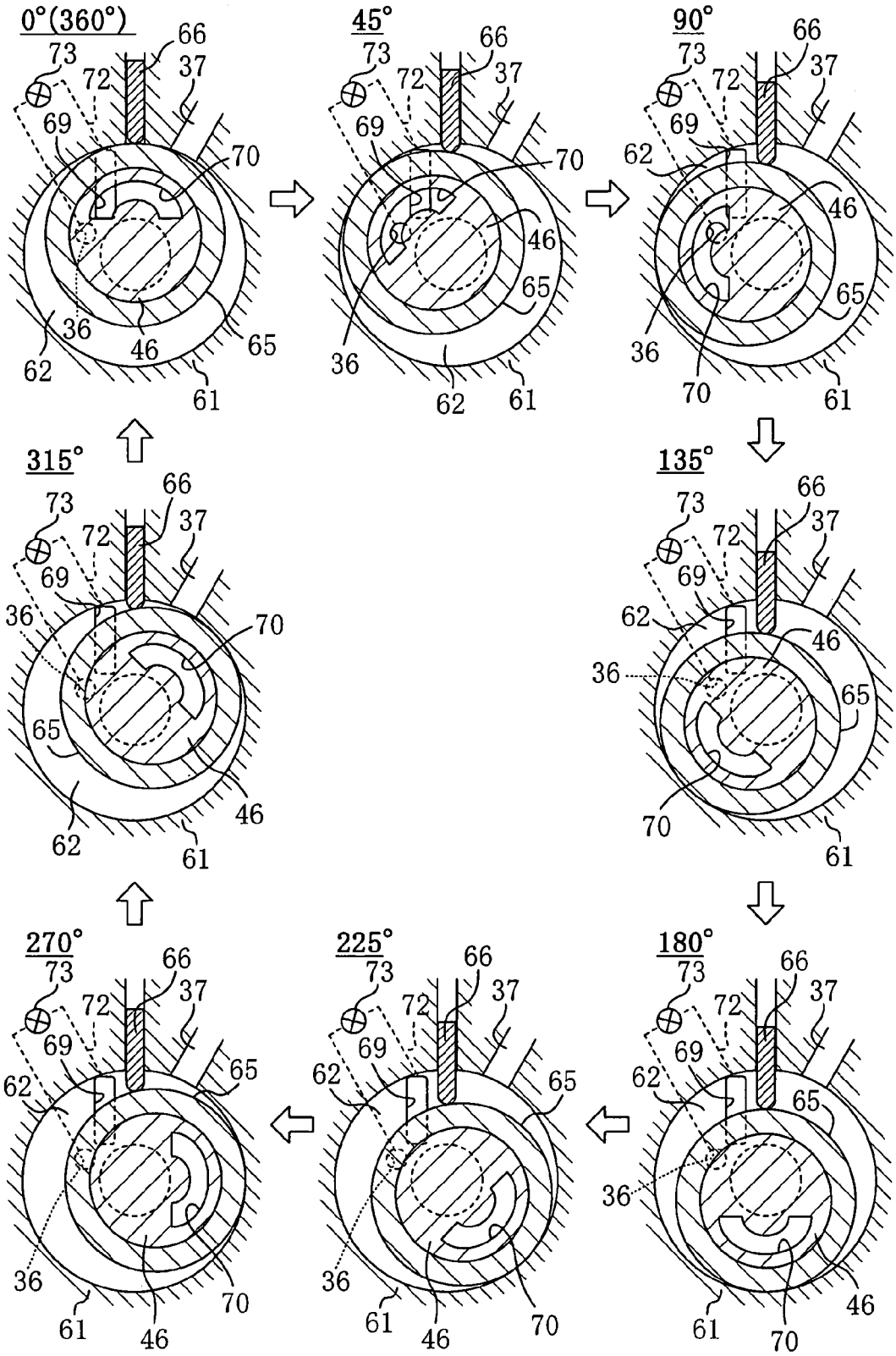
FIG. 19 is a schematic sectional view showing the operation of the expansion mechanism according to embodiment 4.

The above-mentioned blade (66) is provided in the blade groove (68) of the cylinder (61) in a state of free insertion and removal. The blade (66) is biased by a spring, not shown, and its tip (lower end in FIG. 18) is pushed onto the outer circumference of the piston (65). As sequentially shown in FIG. 19 (with the backflow prevention mechanism (80) omitted), even when the piston (65) moves in the cylinder (61), the blade (66) moves vertically through the blade groove (68) so that the tip of the blade (66) is kept in contact with the piston (65). By pushing the tip of the blade (66) onto the circumferential surface of the piston (65), the expansion chamber (62) is partitioned into the high-pressure side and the low-pressure side.

Also in embodiment 4, the inflow port (36) and a position of the expansion chamber (62) during the suction/expansion process are connected by the communication pipe (72), and the communication pipe (72) is provided with the electric-operated valve (73). Therefore, when the expansion mechanism (60) is expanded excessively, since a part of the refrigerant on the inflow port (36) side can be introduced into the expansion chamber (62), the above-mentioned overexpansion can be eliminated.

Moreover, also in embodiment 4, the non-return valve (80), which is the backflow prevention mechanism, is provided close to the expansion chamber (62) than to the electric-operated valve (73) in the communication pipe (72). Accordingly, during normal operation with the electric-operated valve (73) in the state of total closing, it is possible to prevent the refrigerant from flowing from the expansion chamber (62) into the communication pipe (72) and thus reduce the dead volume of the expansion chamber (62). Accordingly, it is possible to improve the power recovery efficiency of the expansion mechanism (60).

Embodiment 5

Embodiment 5 of the present invention is a modification of the configuration of the expansion mechanism (60) according to the above-mentioned embodiment 1. Specifically, the expansion mechanism (60) of the above-mentioned embodiment 1 is configured as the oscillating piston type, whereas the expansion mechanism (60) of embodiment 5 is configured as the scroll type. Besides, whereas the fluid machinery of embodiment 1 is horizontally long, which is what is called the horizontal type, as shown in FIG. 2, the fluid machinery of embodiment 5 is vertically long, which is what is called the vertical type, obtained by turning the fluid machinery of embodiment 1 by 90° (by turning it in counterclockwise direction by 90° in FIG. 2). Here different points of the expansion mechanism (60) of embodiment 5 from the above-mentioned embodiment 1 will be described. It is noted that "upper" and "lower" used in the following description by referring to FIG. 20 respectively stand for "upper" and "lower" in FIG. 20.

Figure 20:
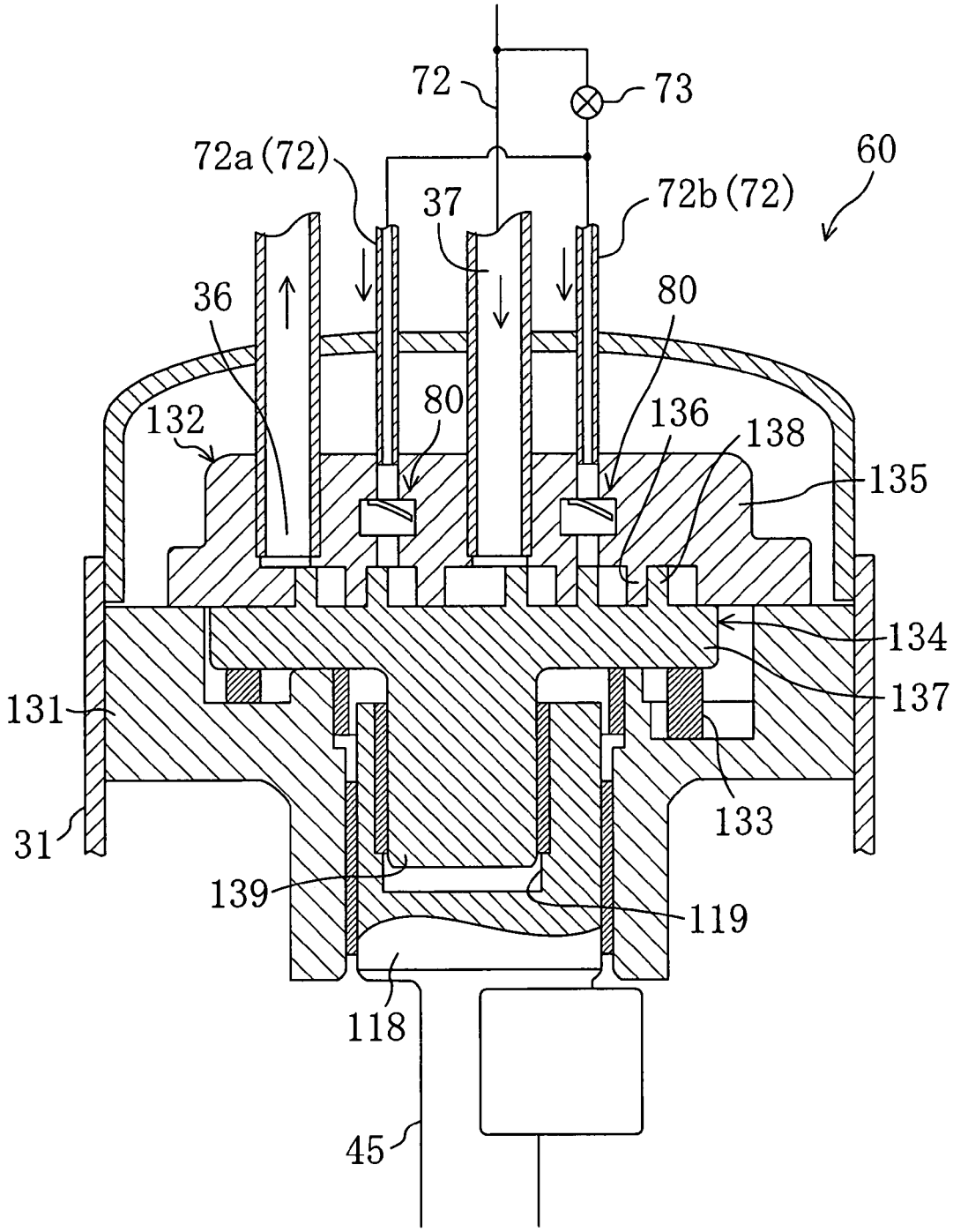
FIG. 20 is a schematic sectional view showing a substantial part of the expansion mechanism according to embodiment 5.

As shown in FIG. 20, the expansion mechanism (60) is equipped with an upper frame (131) fixed to the casing (31), a fixed scroll (132) fixed to the upper frame (131), a movable scroll (134) held via an Oldham's ring (133) on the upper frame (131).

Figure 21:
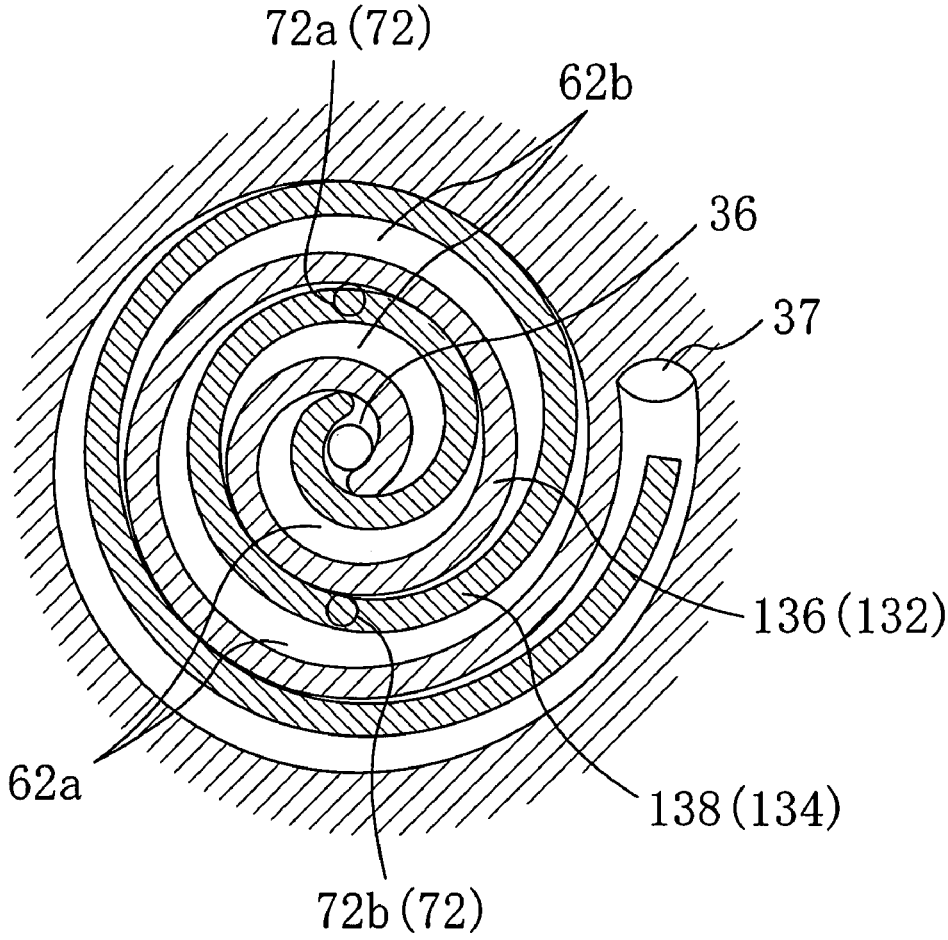
FIG. 21 is a schematic configuration diagram showing an inner structure of the expansion mechanism according to embodiment 5.

The fixed scroll (132) is equipped with a flat-plate-like fixed side end plate (135), and a spiral-wall-like fixed side lap (136) provided vertically on the front face (lower side in FIG. 20) of the fixed side end plate (135). On the other hand, the movable scroll (134) is equipped with a flat-plate-like movable side end plate (137), and a spiral-wall-like movable side lap (138) provided vertically on the front face (upper side in FIG. 20) of the movable side end plate (137). In the expansion mechanism (60), a plurality of fluid chambers (expansion chambers) (62*a*,62*b*) are formed by engaging the fixed side lap (136) of the fixed scroll (132) with the movable side lap (138) of the movable scroll (134) (See FIG. 21). Specifically, the space sandwiched between the inner side of the fixed side lap (136) and the outer side of the movable side lap (138) constitutes a chamber A (62*a*) as a first expansion chamber. On the other hand, the space sandwiched between the outer side of the fixed side lap (136) and the inner side of the movable side lap (138) constitutes a chamber B (62*b*) as a second expansion chamber.

As shown in FIG. 20, a scroll joining portion (118) is formed on the upper end of the shaft (45). In the scroll joining portion (118), a joining hole (119) is formed at a position eccentralized from the center of rotation of the shaft (45). In the movable scroll (134), a joining shaft (139) is protrusively provided on the back side (lower side in FIG. 20) of the movable side end plate (137). The joining shaft (139) is rotatably supported by the joining hole (119) of the scroll joining portion (118). The scroll joining portion (118) of the shaft (45) is rotatably supported on the upper frame (131).

The inflow port (36) and the outflow port (37) are formed on the fixed scroll (132). The inflow port (36) passes through the fixed side end plate (135) in the thickness direction, and the lower end of the inflow port (36) opens in the vicinity of the inner side of the winding start side end portion of the fixed side lap (136). The outflow port (37) passes through the fixed side flat plate in the thickness direction, and the lower end of the outflow port (37) opens in the vicinity of the winding end side end portion of the fixed side lap (136).

Moreover, the communication pipe (communication piping) (72) which diverges from the above-mentioned inflow port (36) and communicates with the above-mentioned expansion chamber (62) is connected to the fixed scroll (60). Specifically, the communication pipe (72) is comprised of a main communication pipe (72) diverged from the inflow port (36) and two communication pipes (72*a*,72*b*) diverged further from the main communication pipe (72).

The two diverging communication pipes (72*a*,72*b*) pass through the fixed side end plate (135) in the thickness direction. Among these two communication pipes (72*a*,72*b*), the communication pipe communicating with the above-mentioned chamber A (62*a*) constitutes a chamber A communication pipe (72*a*), and the communication pipe communicating with the above-mentioned chamber B (62*b*) constitutes a chamber B communication pipe (72*b*). On the front of the fixed side end plate portion (135), the chamber B communication pipe (72*b*) opens in the vicinity of the outer side of the fixed side lap (136) at the position proceeding by approximately 360° from the winding start end along the fixed side lap (136), and the chamber A communication pipe (72*a*) opens in the vicinity of the inner side of the fixed side lap (136) at the position proceeding by further approximately 180° from the foregoing position along the fixed side lap (136).

Besides, the above-mentioned main communication pipe (72) is provided with the electric-operated valve (73) as the circulation control mechanism for regulating the flow rate of the high-pressure refrigerant from the inflow port (36) to the above-mentioned expansion chamber (62). Moreover, in the vicinity of the expansion chamber (62) on the chamber A communication pipe (72*a*) and the chamber B communication pipe (72*b*), spaces with a diameter larger than that of each communication pipe (72*a*,72*b*) are formed. Each space is provided with the non-return valve (80) as the backflow prevention mechanism. The non-return valve (80) is comprised of what is called a reed valve which allows the refrigerant to flow from the communication pipe (72) into the expansion chamber (62*a*,62*b*) and prevents the refrigerant from circulating from the expansion chamber (62*a*,62*b*) to the communication pipe (72). That is, both non-return valves (80) are configured to prevent the refrigerant from flowing from the expansion chamber (62*a*,62*b*) into the communication pipe (72).

<Operation of Expansion Mechanism>

Next, the operation of the expansion mechanism (60) will be described by referring to FIGS. 20 and 22.

Figure 22:
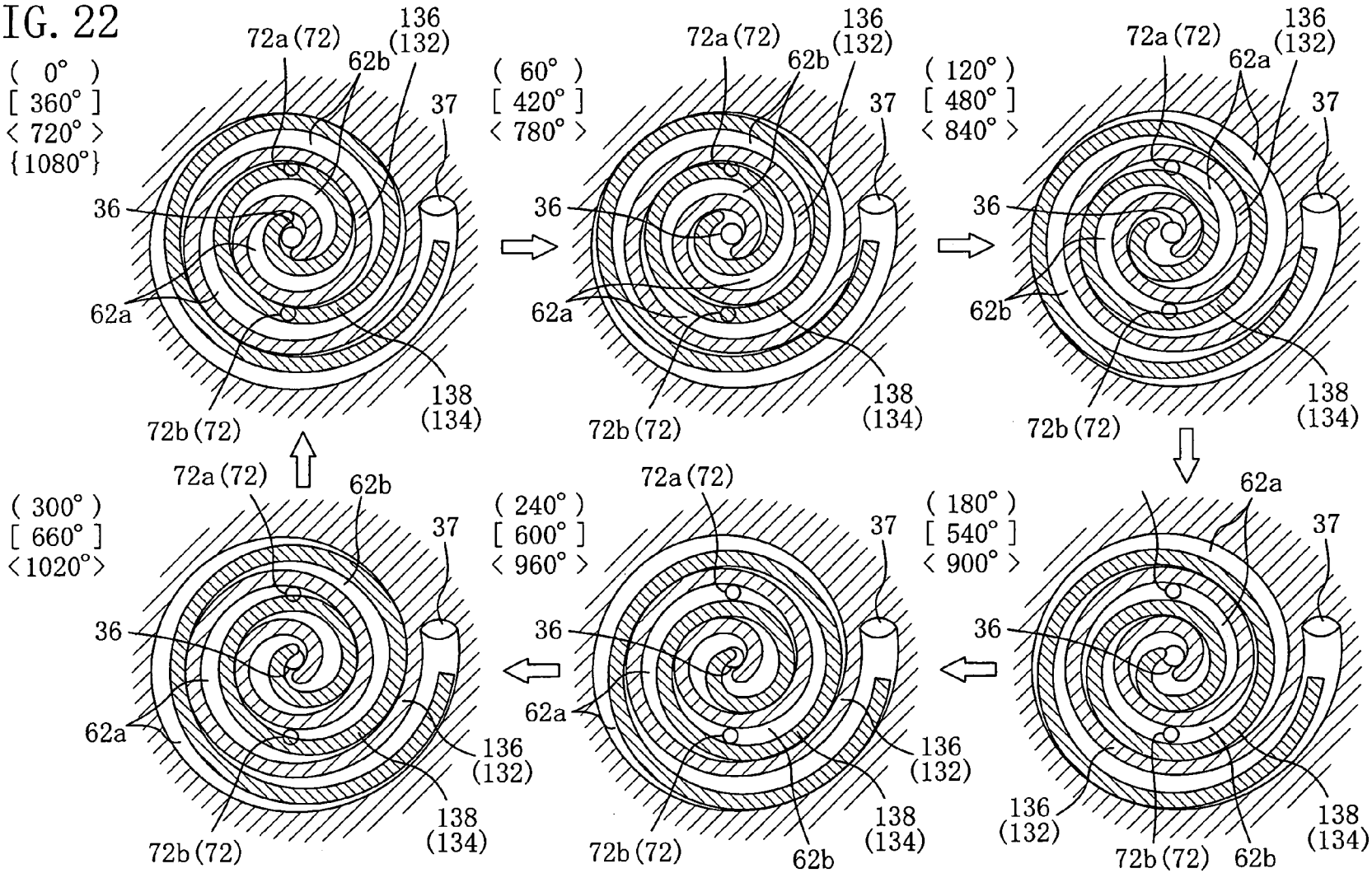
FIG. 22 is a schematic sectional view showing the operation of the expansion mechanism according to embodiment 5.

In FIG. 22, the condition such that the winding start side end portion of the fixed side lap (136) has contact with the inner side of the movable side lap (138), and the winding start side end portion of the movable side lap (138) has contact with the inner side of the fixed side lap (136) is taken as reference 0°.

The high-pressure refrigerant introduced into the inflow port (36) flows into one space sandwiched between the winding start vicinity of the fixed side lap (136) and the winding start vicinity of the movable side lap (138), and the movable scroll (134) accordingly rotates. When the angle of revolution of the movable scroll (134) becomes 360°, a closed space results which is cut off from the chamber A (62*a*), the chamber B (62*b*) and the inflow port (36), so that inflow of the high-pressure refrigerant into the chamber A (62*a*) and the chamber B (62*b*) is terminated.

Then, the refrigerant expands inside the chamber A (62*a*) and the chamber B (62*b*), and the movable scroll accordingly rotates. The volume of the chamber A (62*a*) and the chamber B (62*b*) becomes larger as the movable scroll (134) moves. The chamber B (62*b*) communicates with the inflow port (37) while the angle of rotation of the movable scroll (134) changes from 840° to 900°, and then the refrigerant in the chamber B (62*b*) is fed to the outflow port (37). On the other hand, the chamber A (62*a*) communicates with the inflow port (37) while the angle of rotation of the movable scroll (134) changes from 1020° to 1080°, and then, the refrigerant in the chamber A (62*a*) is fed to the outflow port (37).

In the expansion mechanism (60) with the above-described configuration, when the expansion chamber (62*a*,62*b*) expands excessively, the electric-operated valve (73) of the main communication pipe (72) shown in FIG. 20 is opened to a predetermined degree of opening. As a result, the high-pressure refrigerant diverged from the inflow port (36) to the main communication pipe (72) is introduced via the chamber A communication pipe (72*a*) into the chamber A (62*a*), and at the same time, the refrigerant is also introduced via the chamber B communication pipe (72*b*) into the chamber B (62*b*). This raises the pressure of the refrigerant expanded in both expansion chambers (62*a*,62*b*), thereby eliminating overexpansion in the expansion chamber (62).

On the one hand, when normal operation of the expansion mechanism (60) is carried out, the electric-operated valve (73) turns into the state of total closing. The chamber A communication pipe (72*a*) and the chamber B communication pipe (72*b*) are each provided with the non-return valve (80). This prevents the refrigerant in the chamber A (62*a*) and the chamber B (62*b*) from flowing into the communication pipe (72). Accordingly, the space from the electric-operated valve (73) to the chamber A (62*a*) of the communication pipe (72) and the space from the electric-operated valve (73) to the chamber B (62*b*) of the communication pipe (72) are prevented from dead volume of each expansion chamber (62*a*, 62*b*). Thus, also in embodiment 5, it is also possible to restrain a reduction in the pressure inside the expansion chamber due to the dead volume, making it possible to improve the power recovery efficiency of the positive displacement expander.

Embodiment 6

Embodiment 6 of the present invention is a modification of the configuration of the expansion mechanism (60) according to the above-mentioned embodiment 1. Specifically, the expansion mechanism (60) of the above-mentioned embodiment 1 is configured as the single-layer oscillating piston type, whereas the expansion mechanism (60) of embodiment 6 is configured as the double-layer oscillating piston type. Besides, whereas the fluid machinery of the above-mentioned embodiment 1 is horizontally long, which is what is called the horizontal type, as shown in FIG. 2, the fluid machinery of embodiment 6 is vertically long, which what is called the vertical type, configured by turning the fluid machinery of embodiment 1 by 90° (by turning it in the counterclockwise direction by 90° in FIG. 2). Here different points of the expansion mechanism (60) of the present embodiment from the above-mentioned embodiment 1 will be described. It is note that the terms "upper" and "lower" used in the following description by referring to FIG. 23 respectively stand for "upper" and "lower" in FIG. 23.

Two large diameter eccentric portions (46*a*,46*b*) are formed on the upper end side of the shaft (45) of the compression/expansion unit (30). Each of the large diameter eccentric portions (46*a*,46*b*) are formed so that each diameter is larger than that of the main spindle portion (48). Among the two large diameter eccentric portions (46*a*,46*b*), which are disposed vertically, the lower portion constitutes the first large diameter eccentric portion (46*a*), and the upper portion constitutes the second large diameter eccentric portion (46*b*). The first large diameter eccentric portion (46*a*) and the second large diameter eccentric portion (46*b*) are eccentralized in the same direction. Outside diameter of the second large diameter eccentric portion (46*b*) is larger than the outside diameter of the first large diameter eccentric portion (46*a*). Besides, the second large diameter eccentric portion (46*b*) has a larger amount of eccentricity relative to the shaft center of the main spindle portion (48) than the first large diameter eccentric portion (46*a*).

The expansion-mechanism (60) is what is called a double-layer oscillating piston type fluid machinery. The expansion mechanism portion (60) is provided with two sets of cylinder (61*a*,61*b*) and piston (65*a*,65*b*) in pairs. Besides, the expansion mechanism (60) is provided with a front head (63), an intermediate plate (101), and a rear head (64).

Figure 23:
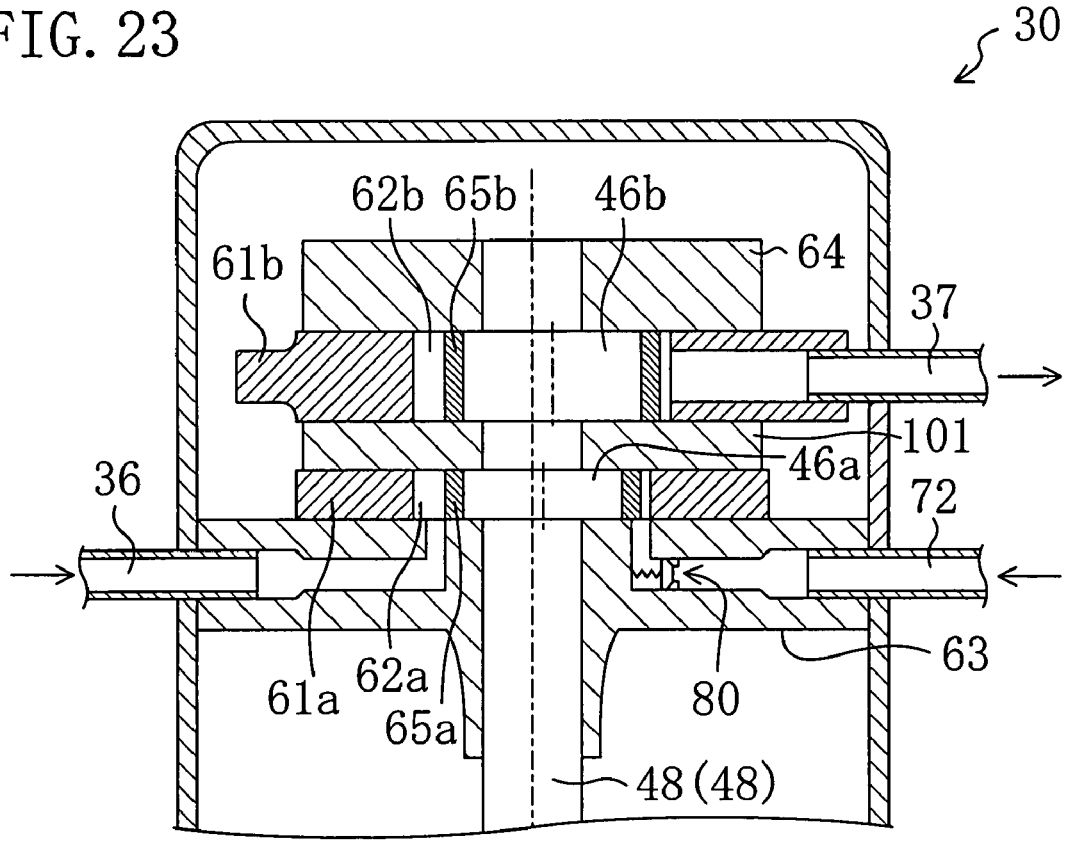
FIG. 23 is a schematic sectional view showing a substantial part of the expansion mechanism according to embodiment 6.

In the above-mentioned expansion mechanism (60), the front head (63), a first cylinder (61*a*), the intermediate plate (101), a second cylinder (61*b*), the rear head (64) are stacked sequentially from bottom to top in FIG. 23. Under this condition, the lower side end face of the first cylinder (61*a*) is blocked by the front head (63), and the upper side end face of the first cylinder (61*a*) is blocked by the intermediate plate (101). On the other hand, the lower side end face of the second cylinder (61*b*) is blocked by the intermediate plate (101), and the upper side end face of the second cylinder (61*b*) is blocked by the rear head (64). The inside diameter of the second cylinder (61*b*) is larger than the inside diameter of the first cylinder (61*a*). Moreover, the vertical thickness of the second cylinder (61*b*) is larger than the thickness of the first cylinder (61*a*).

The above-mentioned shaft (45) passes through the stacked front head (63), first cylinder (61*a*), intermediate plate (101), second cylinder (61*b*), and rear head (64). The first large diameter eccentric portion (46*a*) of the shaft (45) is located in the first cylinder (61*a*), and the second large diameter eccentric portion (46*b*) of the shaft (45) is located in the second cylinder (61*b*).

Figure 24:
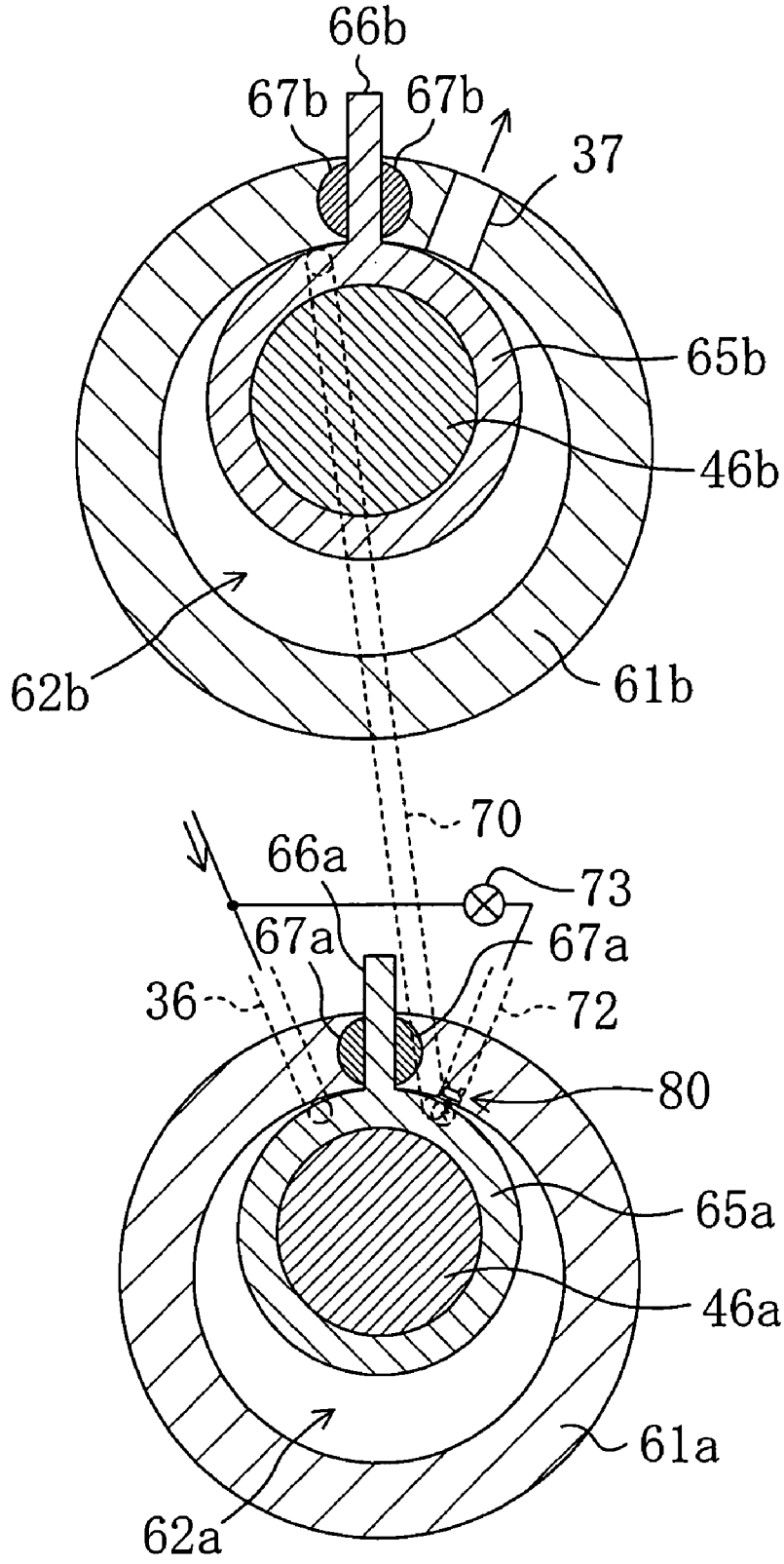
FIG. 24 is a schematic sectional view showing the inside of the expansion mechanism according to embodiment 6.
Figure 25:
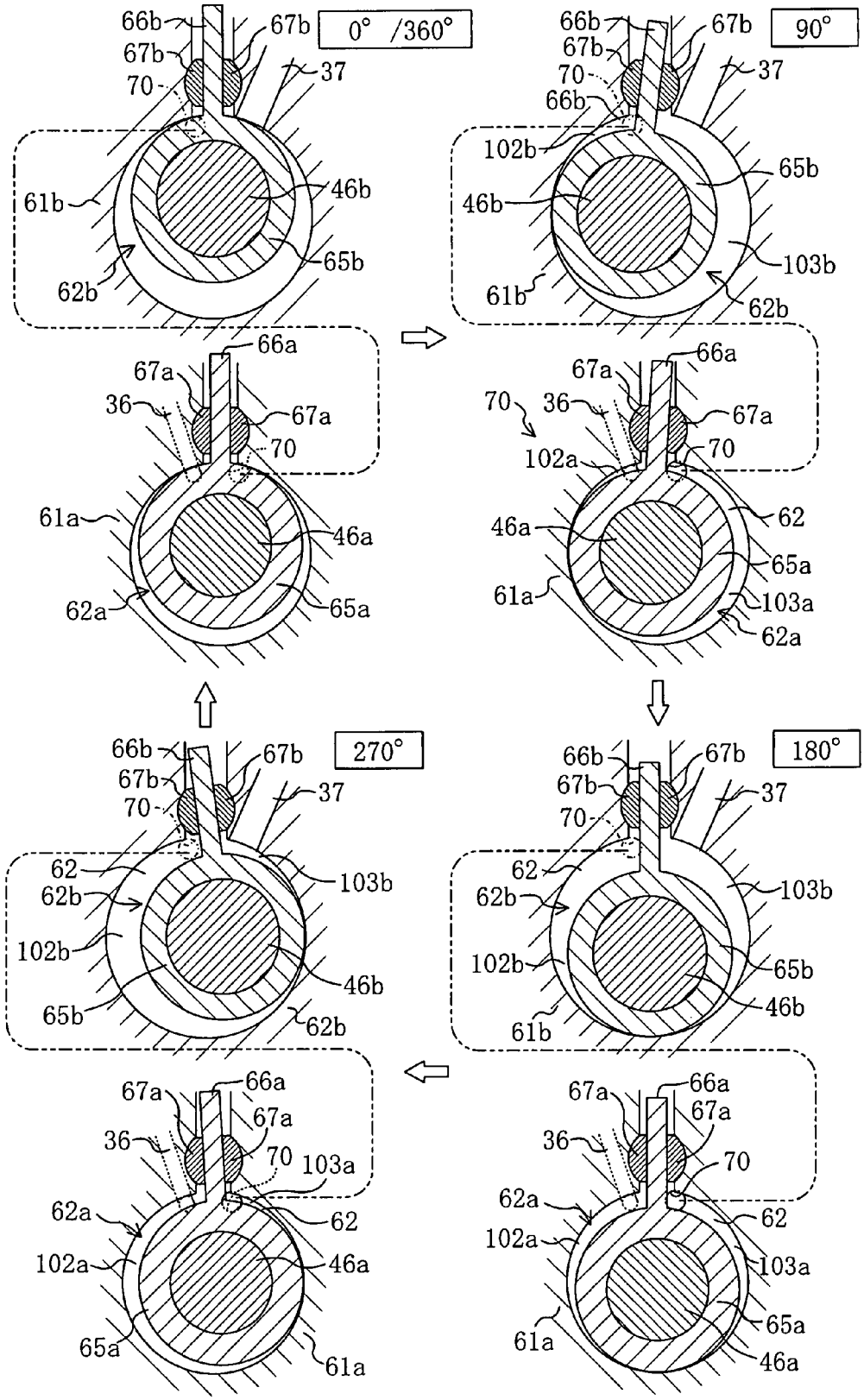
FIG. 25 is a schematic sectional view showing the operation of the expansion mechanism according to embodiment 6.

As shown in FIGS. 24 and 25, a first piston (65*a*) is provided in the first cylinder (61*a*), and a second piston (65*b*) is provided in the second cylinder (61*b*). Both the first piston and the second piston (65*a*,65*b*) are formed in the form of a circular ring or cylinder. The outside diameter of the first piston (65*a*) is equal to the outside diameter of the second piston (65*b*). The inside diameter of the first piston (65*a*) is approximately equal to the outside diameter of the first large diameter eccentric portion (46*a*), and the inside diameter of the second piston (65*b*) is approximately equal to the outside diameter of the second large diameter eccentric portion (46*b*). The first large diameter eccentric portion (46*a*) passes through the first piston (65*a*), and the second large diameter eccentric portion (46*b*) passes through the second piston (65*b*).

The outer circumference of the above-mentioned first piston (65*a*) has sliding-contact with the inner circumference of the first cylinder (61*a*). One end face of the first piston (65*a*) has sliding-contact with the front head (63), and the other end face of the first piston (65*a*) has sliding-contact with the intermediate plate (101). In the first cylinder (61*a*), the first fluid chamber (62*a*), which is a part of the expansion chamber, is formed between the inner circumference of the first cylinder (61*a*) and the outer circumference of the first piston (65*a*).

On the other hand, the outer circumference of the above-mentioned second piston (65*b*) has sliding-contact with the inner circumference of the second cylinder (61*b*). One end face of the second piston (65*b*) has sliding-contact with the rear head (64), and the other end face of the second piston (65*b*) has sliding-contact with the intermediate plate (101). In the second cylinder (61*b*), the second fluid chamber (62*b*), which is a part of the expansion chamber, is formed between the inner circumference of the second cylinder (61*b*) and the outer circumference of the second piston (65*b*).

The above-mentioned first and second pistons (65*a*,65*b*) are integrally provided with the blades (66*a*,66*b*), respectively. The blades (66*a*,66*b*) are formed in the form of a plate extending in the radial direction of the pistons (65*a*,65*b*) and project outwards from the outer circumference of the pistons (65*a*,65*b*).

The above-mentioned cylinders (61*a*,61*b*) are provided with a pair of bushes (67*a*,67*b*). The bushes (67*a*,67*b*) are small pieces formed so that the inner side is a flat plane and the outer side is a circular plate. The pair of bushes (67*a*,67*b*) are disposed so as to hold the blades (66*a*,66*b*) in between. The inner side of each of the bushes (67*a*,67*b*) slides against the blades (66*a*,66*b*) and the outer side of each of the bushes (67*a*,67*b*) slides against the cylinder (61*a*,61*b*). The blades (66*a*,66*b*), which are integral with the pistons (65*a*,65*b*), are supported by the cylinder (61*a*,61*b*) through the bushes (67*a*, 67*b*) and rotatably advance and retract freely against the cylinder (61*a*,61*b*).

A first fluid chamber (62*a*) in the first cylinder (61*a*) is partitioned by the first blade (66*a*), which is integral with the first piston (65*a*). In FIG. 25, a first high-pressure chamber (102*a*) on the high-pressure side is located on the left side of the first blade (66*a*), and a first low-pressure chamber (103*a*) on the low-pressure side is located on the right side of the first blade (66*a*). A second fluid chamber (62*b*) in the second cylinder (61*b*) is partitioned by the second blade (66*b*), which is integral with the second piston (65*b*). In FIG. 25, a second high-pressure chamber (102*b*) on the high-pressure side is located on the left side of the second blade (66*b*), and a second low-pressure chamber (103*b*) on the low-pressure side is located on the right side of the second blade (66*b*).

As shown in FIG. 23, the inflow port (36) is connected with the above-mentioned first cylinder (61*a*). The inflow port (36) is formed in the front head (63) and constitutes an introduction path. The end of the inflow port (36) opens slightly on the left side of the bush (67*a*) in FIG. 24 on the inner circumference of the first cylinder (61*a*). The inflow port (36) can communicate with the first high-pressure chamber (102*a*) (that is, on the high-pressure side of the first fluid chamber (62*a*)). On the other hand, the outflow port (37) is formed in the above-mentioned second cylinder (61*b*). The outflow port (37) opens slightly on the right side of the bush (67*b*) in FIG. 24 on the inner circumference of the second cylinder (61*b*). The outflow port (37) can communicate with the second high-pressure chamber (103*b*) (that is, on the low-pressure side of the second fluid chamber (62*b*)).

A communication path (70) is formed in the above-mentioned intermediate plate (101). The communication path (70) is formed so as to pass through the intermediate plate (101). On the surface of the intermediate plate (101) on the first cylinder (61*a*) side, one end of the communication path (70) opens on the right side of the first blade (66*a*). On the surface of the intermediate plate (101) on the second cylinder (62*b*) side, the other end of the communication path (70) opens on the left side of the second blade (66*b*). The communication path (70) extends obliquely in the thickness direction of the intermediate plate (101), not shown, and can communicate with both a first low-pressure chamber (103*a*) (that is, on the low-pressure side of the first fluid chamber (62*a*)) and a second high-pressure chamber (102*b*) (that is, on the high-pressure side of the second fluid chamber (62*b*)).

Moreover, the communication pipe (72) is connected with the first cylinder (61*a*) as shown in FIGS. 23 and 24. The communication pipe (72) diverges from the inflow port (36) and communicates with the first fluid chamber (62*a*), which is a part of the expansion chamber. The communication pipe (72) is formed inside the front head (63), extends from the outer circumference of the casing (31) toward the shaft (45), and then bends upward so that the opening at the end of the communication pipe (72) faces the inside of the first cylinder (61*a*). The opening of the communication pipe (72) is located near one opening of the above-mentioned communication path (70) in the first cylinder (61*a*).

Similarly to the above-mentioned embodiment, the communication pipe (72) is provided with the electric-operated valve (73) as the circulation control mechanism and the non-return valve (80) as the backflow prevention mechanism. The electric-operated valve (73) is configured to regulate the amount of refrigerant introduced from the above-mentioned communication pipe (72) into the first fluid chamber (62*a*) by adjusting the degree of opening of the electric-operated valve (73). On the other hand, the non-return valve (80) is provided in the communication pipe (72) close to the first cylinder (61*a*) and at the bended portion of the communication pipe (72). The non-return valve (80) is configured to prevent the refrigerant from flowing from the first fluid chamber (62*a*), which is a part of the expansion chamber, into the communication pipe (72).

<Operation of the Expansion Mechanism>

Next, the operation of the expansion mechanism (60) of embodiment 6 will be described.

First, the process in which the high-pressure refrigerant flows into the first high-pressure chamber (102*a*) of the first cylinder (61*a*) will be described by referring to FIG. 25. In FIG. 25, depiction of the communication pipe (72), the electric-operated valve (73), and the non-return valve (80) is omitted.

When the shaft (45) slightly turns from the 0° state for the angle of rotation, the contact position of the first piston (65*a*) and the first cylinder (61*a*) passes through the opening of the inflow port (36), so that the high-pressure refrigerant begins to flow from the inflow port (36) into the first high-pressure chamber (102*a*). Then, as the angle of rotation of the shaft (45) gradually grows larger such as 90°, 180°, and 270°, the high-pressure refrigerant flows into the first high-pressure chamber (102*a*). The high-pressure refrigerant continues to flow into the first high-pressure chamber (102*a*) until the angle of rotation of the shaft (45) reaches 360°.

Next, the process in which the refrigerant expands in the expansion mechanism (60) will be described by referring to FIG. 25. When the shaft (45) slightly turns from 0° state for the angle of rotation, both the first low-pressure chamber (103*a*) and the second high-pressure chamber (102*b*) turn into the state of communication with the communication path (70), and the refrigerant begins to flow from the first low-pressure chamber (103*a*) to the second high-pressure chamber (102*b*). Then, as the angle of rotation of the shaft (45) gradually grows larger such as 90°, 180°, and 270°, the volume of the first low-pressure chamber (103*a*) gradually reduces and the volume of the second high-pressure chamber (102*b*) gradually rises at the same time. As a result, the volume of the expansion chamber (62) gradually increases. The volume of the expansion chamber (62) continues to increase until immediately before the angle of rotation of the shaft (45) reaches 360°. In the course of the increase in the volume of the expansion chamber (62), the refrigerant in the expansion chamber (62) expands. The expansion of the refrigerant rotatably drives the shaft-(45). Thus, the refrigerant in the first low-pressure chamber (103*a*) flows through the continuous passage (70) into the second high-pressure chamber (102*b*) while expanding.

Then, the process in which the refrigerant flows from the second low-pressure chamber (103*b*) of the second cylinder (61*b*) will be described by referring to FIG. 25. In the second low-pressure chamber (103*b*), the refrigerant begins to communicate with the inflow port (37) when the angle of rotation of the shaft (45) is 0°. That is, the refrigerant begins to flow from the second low-pressure chamber (103*b*) into the outflow port (37). Then, as the angle of rotation of the shaft (45) gradually grows larger such as 90°, 180°, 270°, the low-pressure refrigerant after expansion flows from the second low-pressure chamber (103*b*) until the angle of rotation reaches 360°.

In this expansion mechanism (60), when overexpansion occurs in the expansion chamber (62), the electric-operated valve (73) in the communication pipe (72) shown in FIG. 24 is opened to a predetermined degree of opening. As a result, the high-pressure refrigerant diverged from the inflow port (36) into the communication pipe (72) is introduced into the first low-pressure chamber (103*a*) of the first cylinder (61*a*). Then the pressure of the refrigerant, which is expanded through the first low-pressure chamber (103*a*) and the second high-pressure chamber (102*b*), is increased, thereby eliminating overexpansion in the expansion chamber (62).

On the other hand, when the expansion mechanism (60) is in normal operation, the electric-operated valve (73) is in the state of total closing. Similar to the above-mentioned embodiment, the communication pipe (72) is provided with the non-return valve (80). Accordingly, the refrigerant is prevented from flowing from the first fluid chamber (62*a*) into the communication pipe (72). This prevents the space from the electric-operated valve (73) in the communication pipe (72) to the first fluid chamber (62*a*) from becoming dead volume of the expansion chamber (62). Thus, also in embodiment 6, it is possible to prevent a reduction in the pressure in the expansion chamber (62) due to dead volume, and improve the power recovery efficiency of the positive displacement expander.

Another Embodiment

In connection with the above-mentioned embodiments, the present invention may be configured as follows.

In the above-mentioned embodiments, description has been made of the compression/expansion unit (30) which is equipped with the expansion mechanism (60), the compression mechanism (50), and the motor (40) provided in the single casing (31). The present invention may be applied to an expander formed separately from the compressor.

Figure 26:
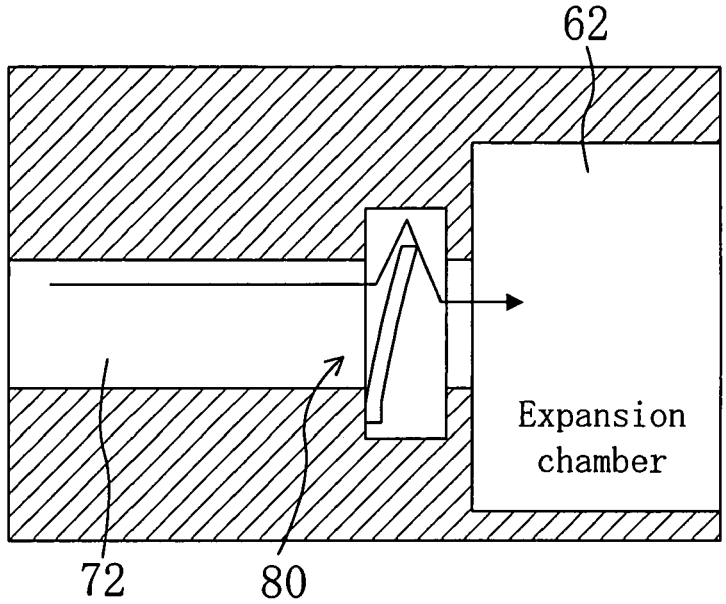
FIG. 26 is a schematic sectional view showing a first example of a backflow prevention mechanism according to another embodiment.
Figure 27:
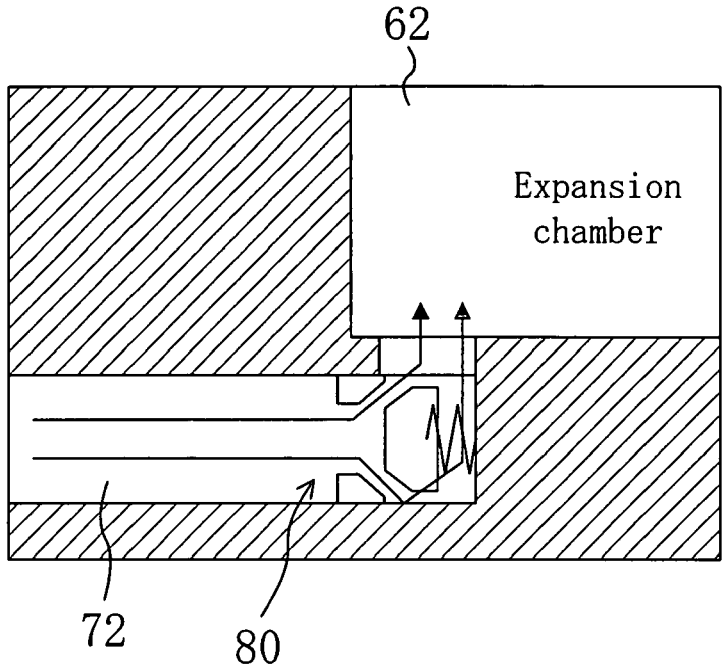
FIG. 27 is a schematic sectional view showing a second example of the backflow prevention mechanism according to another embodiment.

In the above-mentioned embodiment 1, the non-return valve as shown in FIG. 12 is provided as the backflow prevention mechanism (80). However, for example, similarly to embodiment 5, a non-return valve comprised of the reed valve as shown in FIG. 26 may be employed as the backflow prevention mechanism (80). When, for example, the communication pipe (72) is formed in the front head or rear head, the non-return valve as shown in FIG. 27 may be employed similarly to embodiment 6. Thus, the backflow prevention mechanism (80) may be configured in any manner according to the configuration of the expansion mechanism (60) and the communication pipe (72).

Figure 28:
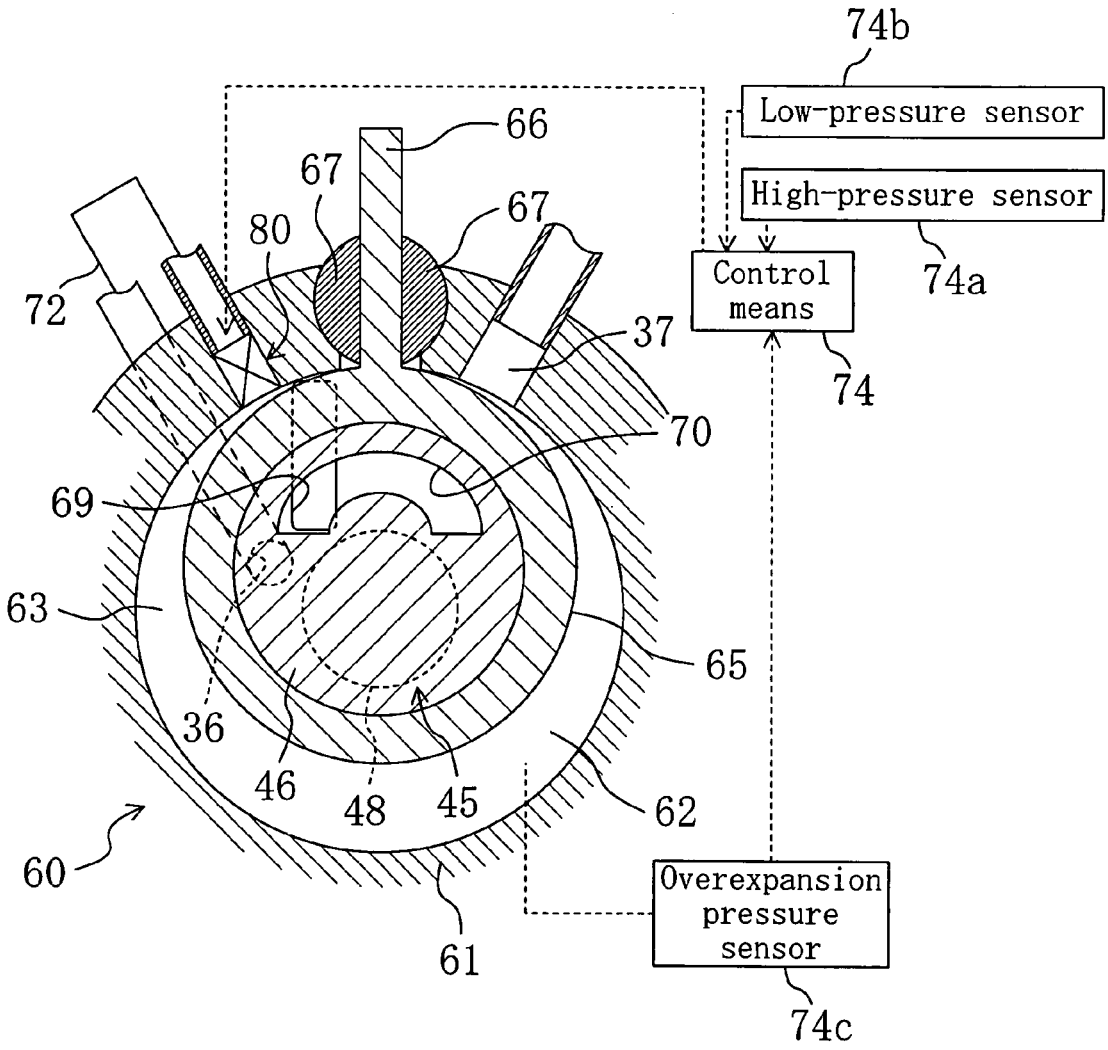
FIG. 28 is a schematic sectional view showing a third example of a backflow prevention mechanism according to another embodiment.

In the above-mentioned embodiments, the circulation control mechanisms (73,75,76) and the backflow prevention mechanism (80) are separately configured. However, the backflow prevention mechanism (80) may also be configured to serve as the circulation control mechanism. Specifically, such a configuration may be employed that as shown in, for example, FIG. 28, in the communication pipe (72) in the vicinity of the expansion chamber (62), the electric-operated valve (80) is disposed instead of the non-return valve in embodiment 1 with the electric-operated valve (73) shown in FIG. 4 omitted. In this configuration, it is possible to regulate the amount of refrigerant from the communication pipe (72) to the expansion chamber (62) by opening the electric-operated valve, which also serves as the backflow prevention mechanism (80), to a predetermined degree of opening, thereby eliminating overexpansion. On the other hand, when the electric-operated valve as the backflow prevention mechanism (80) is cut off, the refrigerant is stopped from supplying from the communication pipe (72) to the expansion chamber (62) and normal operation is performed. Here, since the refrigerant is prevented from flowing from the expansion chamber (62) to the communication pipe (72) when the electric-operated valve as the backflow prevention mechanism (80) is closed, it is possible to effectively reduce the dead volume of the expansion chamber (62). Accordingly, also in this embodiment, it is possible to prevent the reduction in the power recovery efficiency due to the dead volume. Besides, in this configuration, since a single component can serve to function both as the circulation control mechanism and the backflow prevention mechanism, it is also possible to reduce the number of parts for the expansion mechanism (60).

INDUSTRIAL APPLICABILITY

As mentioned above, the present invention is useful in positive displacement expanders equipped with the expansion mechanism, which generates power when the high-pressure fluid expands, and fluid machineries equipped with the expanders.

What is claimed is:

1. A positive displacement expander comprising:

an expansion mechanism in which a high-pressure fluid is expanded in an expansion chamber to generate power;

a communication path which diverges from a fluid inflow side of the expansion chamber and communicates with a suction/expansion process position of the expansion chamber; and a circulation control mechanism disposed in the communication path for regulating a flow rate of the fluid, wherein the expansion mechanism is provided with a backflow prevention mechanism for preventing the fluid from flowing from the expansion chamber into the communication path, and the backflow prevention mechanism is disposed closer to the expansion chamber than the circulation control mechanism in the communication path.

2. The positive displacement expander according to claim 1, wherein the backflow prevention mechanism is comprised of a non-return valve.

3. A positive displacement expander comprising:

an expansion mechanism in which a high-pressure fluid is expanded in an expansion chamber to generate power;

a communication path which diverges from a fluid inflow side of the expansion chamber and communicates with a suction/expansion process position of the expansion chamber; and a circulation control mechanism disposed in the communication path for regulating a flow rate of the fluid, wherein the expansion mechanism is provided with a backflow prevention mechanism for preventing the fluid from flowing from the expansion chamber into the communication path, and the circulation control mechanism is comprised of an electric-operated valve capable of adjusting the degree of opening.

4. A positive displacement expander comprising:

an expansion mechanism in which a high-pressure fluid is expanded in an expansion chamber to generate power;

a communication path which diverges from a fluid inflow side of the expansion chamber and communicates with a suction/expansion process position of the expansion chamber; and a circulation control mechanism disposed in the communication path for regulating a flow rate of the fluid, wherein the expansion mechanism is provided with a backflow prevention mechanism for preventing the fluid from flowing from the expansion chamber into the communication path, and the circulation control mechanism is comprised of an electromagnetically opening/closing valve capable of opening and closing.

5. A positive displacement expander comprising:

an expansion mechanism in which a high-pressure fluid is expanded in an expansion chamber to generate power;

a communication path which diverges from a fluid inflow side of the expansion chamber and communicates with a suction/expansion process position of the expansion chamber; and a circulation control mechanism disposed in the communication path for regulating a flow rate of the fluid, wherein the expansion mechanism is provided with a backflow prevention mechanism for preventing the fluid from flowing from the expansion chamber into the communication path, and the circulation control mechanism is comprised of a differential pressure regulating valve which opens when differential pressure between pressure of the fluid during an expansion process in the expansion chamber and pressure on the fluid outflow side is greater than a predetermined value.

6. A positive displacement expander comprising:

an expansion mechanism in which a high-pressure fluid is expanded in an expansion chamber to generate power;

a communication path which diverges from a fluid inflow side of the expansion chamber and communicates with a suction/expansion process position of the expansion chamber; and a circulation control mechanism disposed in the communication path for regulating a flow rate of the fluid, wherein the expansion mechanism is provided with a backflow prevention mechanism for preventing the fluid from flowing from the expansion chamber into the communication path, and the expansion mechanism is configured to carry out an expansion process of a vapor compression type refrigeration cycle in which the high pressure becomes super-critical pressure.

7. The positive displacement expander according to claim 6, wherein the expansion mechanism is configured to carry out an expansion process of a vapor compression type refrigeration cycle using a CO2 refrigerant.

8. A positive displacement expander comprising:

an expansion mechanism in which a high-pressure fluid is expanded in an expansion chamber to generate power;

a communication path which diverges from a fluid inflow side of the expansion chamber and communicates with a suction/expansion process position of the expansion chamber; and a circulation control mechanism disposed in the communication path for regulating a flow rate of the fluid, wherein the expansion mechanism is provided with a backflow prevention mechanism for preventing the fluid from flowing from the expansion chamber into the communication path, and the expansion mechanism is configured to be a rotary expansion mechanism in which rotation power is recovered by means of expansion of the fluid.

9. A fluid machinery comprising:

a positive displacement expander;

a motor; and a compressor driven by the positive displacement expander and the motor in order to compress a fluid, the positive displacement expander, the motor, and the compressor being provided in a casing, wherein the positive displacement expander comprises:

an expansion mechanism in which the compressed fluid is expanded in an expansion chamber to generate power;

a communication path which diverges from a fluid inflow side of the expansion chamber and communicates with a suction/expansion process position of the expansion chamber; and a circulation control mechanism disposed in the communication path for regulating a flow rate of the fluid, wherein the expansion mechanism is provided with a backflow prevention mechanism for preventing the fluid from flowing from the expansion chamber into the communication path.

* * * * *